US010850525B2

(12) United States Patent
Nagashima et al.

(10) Patent No.: US 10,850,525 B2
(45) Date of Patent: Dec. 1, 2020

(54) LIQUID CONTAINER AND LIQUID EJECTION DEVICE

(71) Applicant: SEIKO EPSON CORPORATION, Tokyo (JP)

(72) Inventors: Takumi Nagashima, Matsumoto (JP); Hiroyuki Kawate, Hokuto (JP); Hiroyoshi Ozeki, Shiojiri (JP); Manabu Yamaguchi, Shiojiri (JP); Koichi Toba, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/428,796

(22) Filed: May 31, 2019

(65) Prior Publication Data

US 2019/0366723 A1 Dec. 5, 2019

(30) Foreign Application Priority Data

Jun. 1, 2018 (JP) ..... 2018-105797

(51) Int. Cl.
*B41J 2/175* (2006.01)

(52) U.S. Cl.
CPC ..... *B41J 2/17523* (2013.01); *B41J 2/17513* (2013.01); *B41J 2002/17516* (2013.01)

(58) Field of Classification Search
CPC . B41J 2/01; B41J 2/175; B41J 2/17503; B41J 2/17509; B41J 2/17513; B41J 2/1752; B41J 2/17523; B41J 2/17553; B41J 29/13; B41J 2002/17516
See application file for complete search history.

(56) References Cited

U.S. PATENT DOCUMENTS 6,361,159 B1 * 3/2002 Chino ..... B41J 2/17523 347/86
7,871,157 B2 * 1/2011 Koike ..... B41J 2/17509 347/86
8,033,659 B2 * 10/2011 Kobayashi ..... B41J 2/17509 347/92
2007/0219492 A1 * 9/2007 Lucas ..... A61M 5/5013 604/110
2018/0043695 A1 2/2018 Kawate et al.
2018/0104955 A1 4/2018 Kawate et al.

FOREIGN PATENT DOCUMENTS

JP 2018-065373 A 4/2018
JP 2018-065374 A 4/2018

* cited by examiner

*Primary Examiner* — Anh T Vo
(74) *Attorney, Agent, or Firm* — Oliff PLC

(57) ABSTRACT

A liquid container includes: a flexible bag provided with a liquid container that internally contains the liquid; a liquid outlet member attached to a one end portion of the bag; and a connection member that is attached to the one end portion of the bag so as to cover the liquid outlet member and a portion of the one end portion of the bag from the outside. The bag includes a sealed portion on an outer periphery side relative to the liquid container, the sealed portion includes a one end portion-side sealed portion, and a first width, which is a width of the one end portion-side sealed portion in at least a surrounding region of the connection member, is larger than a second width, which is a width of the sealed portion at other ends of the bag.

5 Claims, 16 Drawing Sheets

LIQUID CONTAINER AND LIQUID EJECTION DEVICE

The present application is based on, and claims priority from JP Application Serial Number 2018-105797, filed Jun. 1, 2018, the disclosure of which is hereby incorporated by reference herein in its entirety.

BACKGROUND

1. Technical Field

The present disclosure relates to a liquid container and a liquid ejection device.

2. Related Art

A liquid container including an ink pack and a connection member for connecting the ink pack to a liquid ejection device is disclosed in JP-A-2018-65374, as a liquid container for supplying liquid to the liquid ejection device, for example. A user places the liquid container in a case whose upper face is open by operating a handle provided in the connection member, and inserts the case to the liquid ejection device, and as a result, the liquid container is attached to the liquid ejection device.

If a portion in which ink of an ink pack is contained is present in the vicinity of a connection member, in such a liquid container, the connection member is likely to be affected by surface waviness and ripples of the ink inside the ink pack. When surface waviness and ripples occur in ink, the position of the connection member relative to the liquid ejection device is likely to be shifted, and it is possible that it becomes difficult to supply ink stably to the liquid ejection device. This problem occurs, not only in the ink pack in which ink is contained, but also in a liquid container in which liquid is contained in a flexible bag and in a liquid ejection device to which the liquid container is attached.

SUMMARY

According to one aspect of the present disclosure, a liquid container for supplying liquid to a liquid ejection device is provided. The liquid container includes: when three directions that orthogonally intersect each other are denoted as a D direction, a T direction, and a W direction, a positive direction of the D direction is denoted as a +D direction, and the direction opposite to the +D direction is denoted as a −D direction, a direction in which the size of an external shape of the liquid container is smallest is the T direction, and a direction orthogonal to the D direction and the T direction is the W direction, the D direction and the W direction extending in a horizontal direction in a state in which the liquid container is attached to the liquid ejection device, a flexible bag provided with a liquid container that internally contains the liquid; a liquid outlet member attached to a one end portion of the bag on the −D direction side; and a connection member that is attached to the one end portion so as to cover the liquid outlet member and a portion of the one end portion from the outside. The bag includes a sealed portion on an outer periphery side relative to the liquid container, the sealed portion includes a one end portion-side sealed portion that is formed along the W direction at an end on the −D direction side, a first width, which is a width of the one end portion-side sealed portion in at least a surrounding region of the connection member, is larger than a second width, which is a width of the sealed portion at other ends of the bag, and an end, on the +D direction side, of a portion, of the one end portion-side sealed portion, having the first width is located on the +D direction side relative to an end of the connection member on the +D direction side.

According to another aspect of the present disclosure, a liquid ejection device is provided to which a liquid container including a liquid outlet member is detachably attached. The liquid ejection device includes a hollow liquid introduction needle to be inserted into the liquid outlet member. A leading end portion of the liquid introduction needle is constituted by a combination of a truncated cone that has a first bottom face and an upper face whose diameter is smaller than that of the first bottom face, and a cone that is provided on the upper face of the truncated cone, and has a second bottom face whose diameter is smaller than that of the upper face of the truncated cone, and the central axis of the cone matches the central axis of the truncated cone.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

A. First Embodiment

Figure 1:
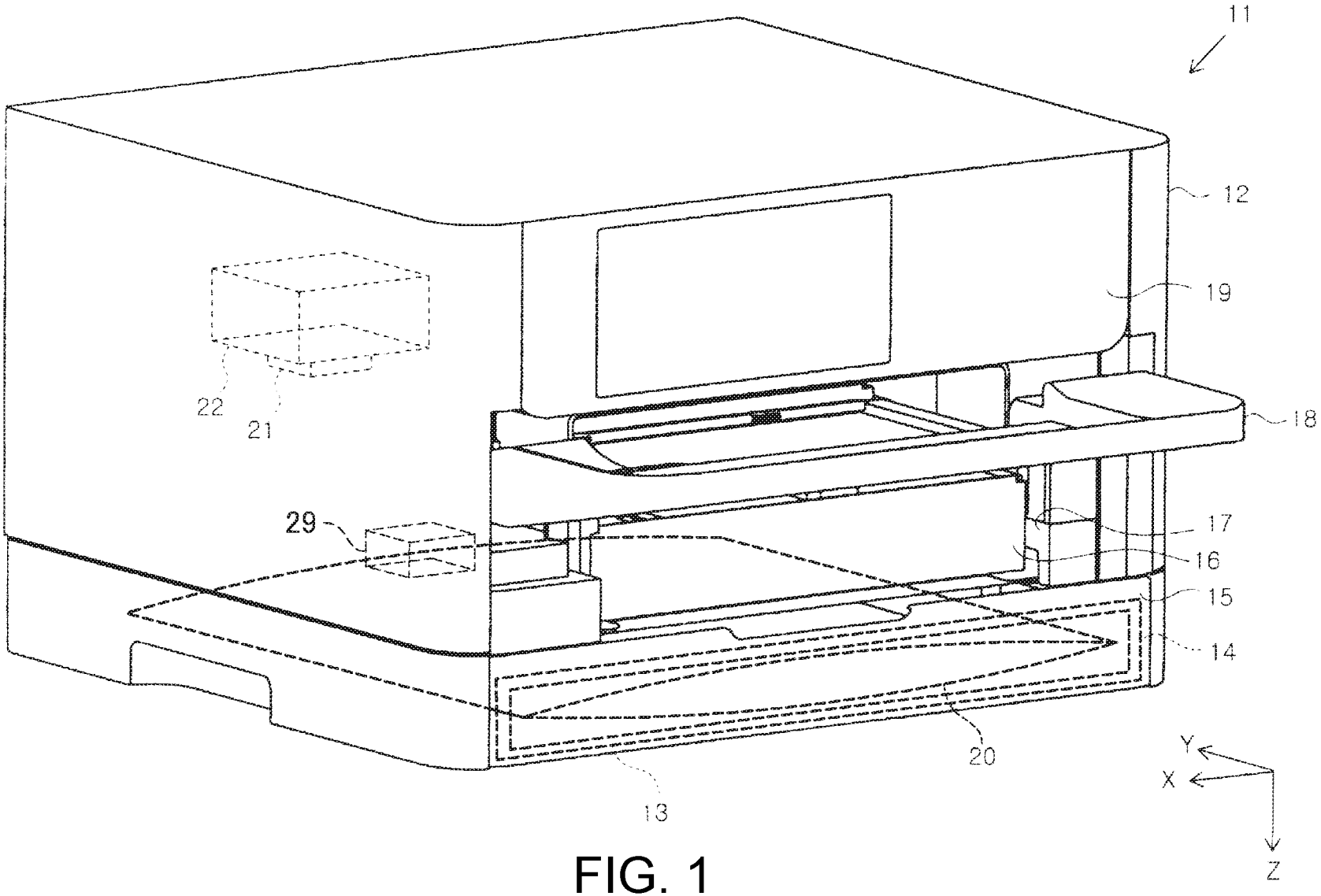
FIG. 1 is a perspective view of a liquid ejection device.

FIG. 1 is a perspective view of a liquid ejection device 11. The liquid ejection device 11 is an inkjet printer that forms a print image by ejecting ink, which is an example of liquid, onto a medium such as paper. The liquid ejection device 11 includes an exterior body 12 having a substantially rectangular parallelepiped shape. In a front face portion of the exterior body 12, a pivotable front cover 15 that covers an attachment portion 14 to which a container 13 is detachably attached, and an attachment port 17 through which a cassette 16 that can store a medium is attached are arranged in the stated order upward from the bottom side. Furthermore, a discharge tray 18 to which a medium is discharged and an operation panel 19 for a user to operate the liquid ejection device 11 are arranged above the attachment port 17. Note that the front face of the exterior body 12 refers to a side face that has a height and a width, and on which operations on the liquid ejection device 11 are mainly performed.

A container 13 whose size is approximately the same as the width of the liquid ejection device 11 can be attached to the attachment portion 14. A liquid container 20 whose size is approximately the same as the width of the container 13 is removably mounted to the container 13. That is, the liquid container 20 is mounted on the container 13 that is detachably attached to the liquid ejection device 11. The container 13 can be detachably attached to the attachment portion 14 even in a state in which the liquid container 20 is not held. When the container 13 is attached to the attachment portion 14, the front cover 15 is opened, the container 13 is inserted into an accommodation space inside the attachment portion 14, and is moved along a movement path that extends in the depth direction. A connection mechanism 29 for coupling the container 13 to the liquid ejection device 11 is provided on a depth side of the accommodation space.

A liquid ejector 21 that ejects liquid from a nozzle and a carriage 22 that moves back and forth along a scanning axis that matches the width direction of the liquid ejection device 11 are provided inside the exterior body 12. The liquid ejector 21 moves along with the carriage 22, and performs printing on a medium by ejecting liquid that is supplied from the liquid container 20 mounted in the container 13 via the connection mechanism 29 to the medium. Note that, in other embodiments, the liquid ejector 21 may be a line head that does not move back and forth and whose position is fixed.

In the present embodiment, a direction that is orthogonal to the movement path when the container 13 is attached to the attachment portion 14 is the width direction, and a direction in which the movement path extends is a depth direction. Also, the width direction and the depth direction substantially extend along a horizontal plane. In the diagram, the gravity direction is indicated by a Z axis assuming that the exterior body 12 is placed on a horizontal plane, and the movement direction when the container 13 is attached to the attachment portion 14 is indicated by a Y axis. The movement direction may also be expressed as an attachment direction or an insertion direction to the attachment portion 14. The direction opposite to the movement direction may also be expressed as a removal direction. Also, the width direction is indicated by an X axis that is orthogonal to the Z axis and Y axis. That is, the width direction, the gravity direction, and the attachment direction orthogonally intersect each other, and are respectively directions when the lengths of width, height, and depth are expressed.

Figure 2:
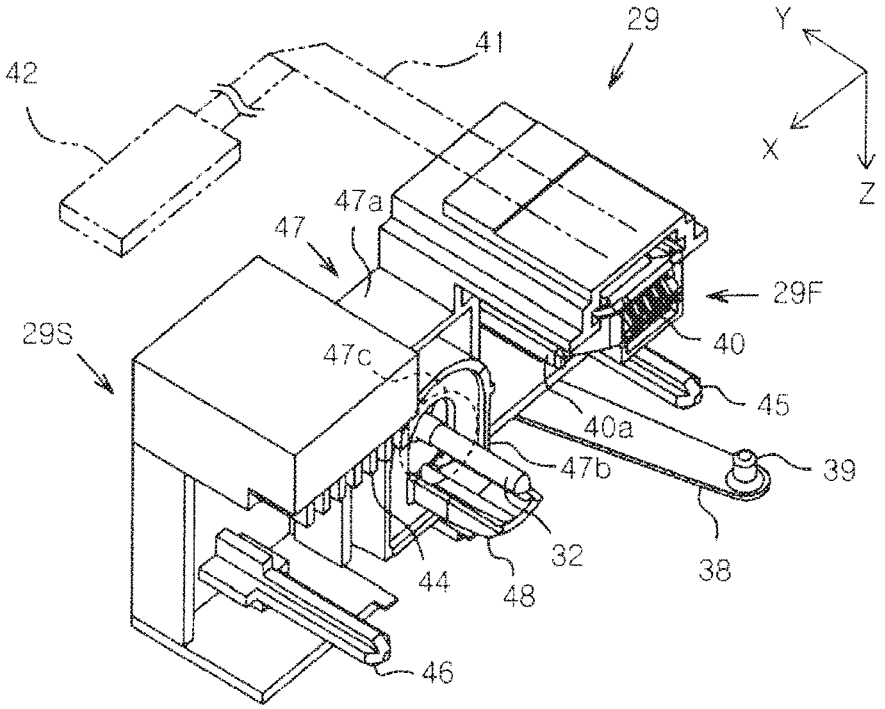
FIG. 2 is a perspective view of a connection mechanism.

FIG. 2 is a perspective view of the connection mechanism 29. The connection mechanism 29 includes a first connection mechanism 29F and a second connection mechanism 29S respectively at positions that sandwich the liquid introduction needle 32 in the width direction. The first connection mechanism 29F is arranged vertically below the liquid introduction needle 32, and includes an arm 38 that protrudes in the removal direction. A first locking portion 39 is provided at a leading end of the arm 38. The arm 38 is configured such that a leading end side is pivotable about a base end side. The first locking portion 39 protrudes vertically upward from the arm 38, for example, and is arranged on a movement path of the container 13 when attached to the attachment portion 14. When the container 13 is attached to the attachment portion 14, the first locking portion 39 is fitted into an engagement groove 78, shown in FIGS. 4 and 5, that is provided in a back face of the container 13, and restricts the container 13 from simply detaching from the attachment portion 14.

The first connection mechanism 29F includes a terminal unit 40 that is arranged vertically upward of the liquid introduction needle 32, and protrudes in the removal direction. The terminal unit 40 is coupled to a control device 42 via an electric line 41 such as a flat cable. The terminal unit 40 is arranged such that an upper end protrudes in the removal direction relative to a lower end, and is directed obliquely downward. Also, two guide projections 40*a* that protrude in the width direction and extend along the attachment direction are arranged on respective sides of the terminal unit 40 in the width direction.

The second connection mechanism 29S includes a block 44 for preventing erroneous insertion that is arranged vertically upward of the liquid introduction needle 32, and protrudes in the removal direction. The block 44 has protrusions and recesses that are arranged so as to face downward.

The connection mechanism 29 includes a first positioning protrusion 45, a second positioning protrusion 46, an extrusion mechanism 47 that is arranged so as to surround the liquid introduction needle 32, and a liquid receiver 48 that protrudes in the removal direction below the liquid introduction needle 32. The first positioning protrusion 45 and the second positioning protrusion 46 are respectively included in the first connection mechanism 29F and the second connection mechanism 29S, and are arranged side by side in the width direction so as to sandwich the liquid introduction needle 32. The first positioning protrusion 45 and the second positioning protrusion 46 are a pair of rod-like protrusions that project, in parallel, in the removal direction. The projection lengths of the first positioning protrusion 45 and the second positioning protrusion 46 in the removal direction are larger than the projection length of the liquid introduction needle 32 in the removal direction.

The extrusion mechanism 47 includes a frame member 47*a* that surrounds a base end portion of the liquid introduction needle 32, a pressing portion 47*b* that protrudes in the removal direction from the frame member 47*a*, and a biasing portion 47*c* that biases the container 13 in the removal direction via the pressing portion 47*b*. The biasing portion 47*c* may be a coil spring that is interposed between the frame member 47*a* and the pressing portion 47*b*, for example.

Figure 3:
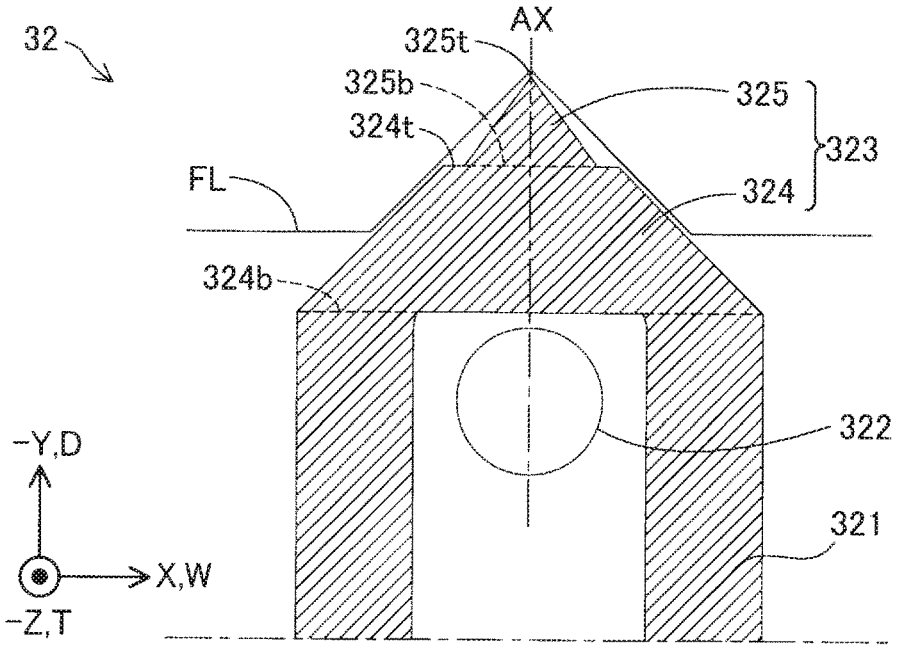
FIG. 3 is a cross-sectional view of a liquid introduction needle at a portion near its leading end.

FIG. 3 is a cross-sectional view of the liquid introduction needle 32 at a portion near its leading end. The liquid introduction needle 32 is a hollow needle that is to be inserted into a liquid outlet member 66 included in the liquid container 20, as will be described later. The liquid introduction needle 32 includes a cylindrical portion 321 and a leading end portion 323. A liquid introduction port 322 through which liquid is introduced from the liquid container 20 is provided in the cylindrical portion 321. In the present embodiment, the liquid introduction port 322 faces downward.

The leading end portion 323 of the liquid introduction needle 32 is constituted by a combination of a truncated cone 324 and a cone 325. The truncated cone 324 has a first bottom face 324*b* and an upper face 324*t* whose diameter is smaller than that of the first bottom face 324*b*. The cone 325 is provided on the upper face 324*t* of the truncated cone 324. The cone 325 has a second bottom face 325*b* whose diameter is smaller than that of the upper face 324*t* of the truncated cone 324, and an apex 325*t*. The central axis AX of the cone 325 matches the central axis AX of the truncated cone 324. In the present embodiment, the truncated cone 324 and the cone 325 are integrally formed in the liquid introduction needle 32. Therefore, the first bottom face 324*b* and the upper face 324*t* of the truncated cone 324 and the second bottom face 325*b* of the cone 325 include virtual faces that are involved in the liquid introduction needle 32, as indicated by broken lines in FIG. 3. As a result of being configured by combining the truncated cone 324 and the cone 325, the leading end portion 323 of the liquid introduction needle 32 has a cone shape as a whole, and has a level difference in its conical surface. The liquid introduction needle 32 breaks, when being inserted into an un-used liquid container 20, a film FL included in the liquid outlet member 66 of the liquid container 20, and comes into in communication with the inside of the liquid outlet member 66.

Figure 4:
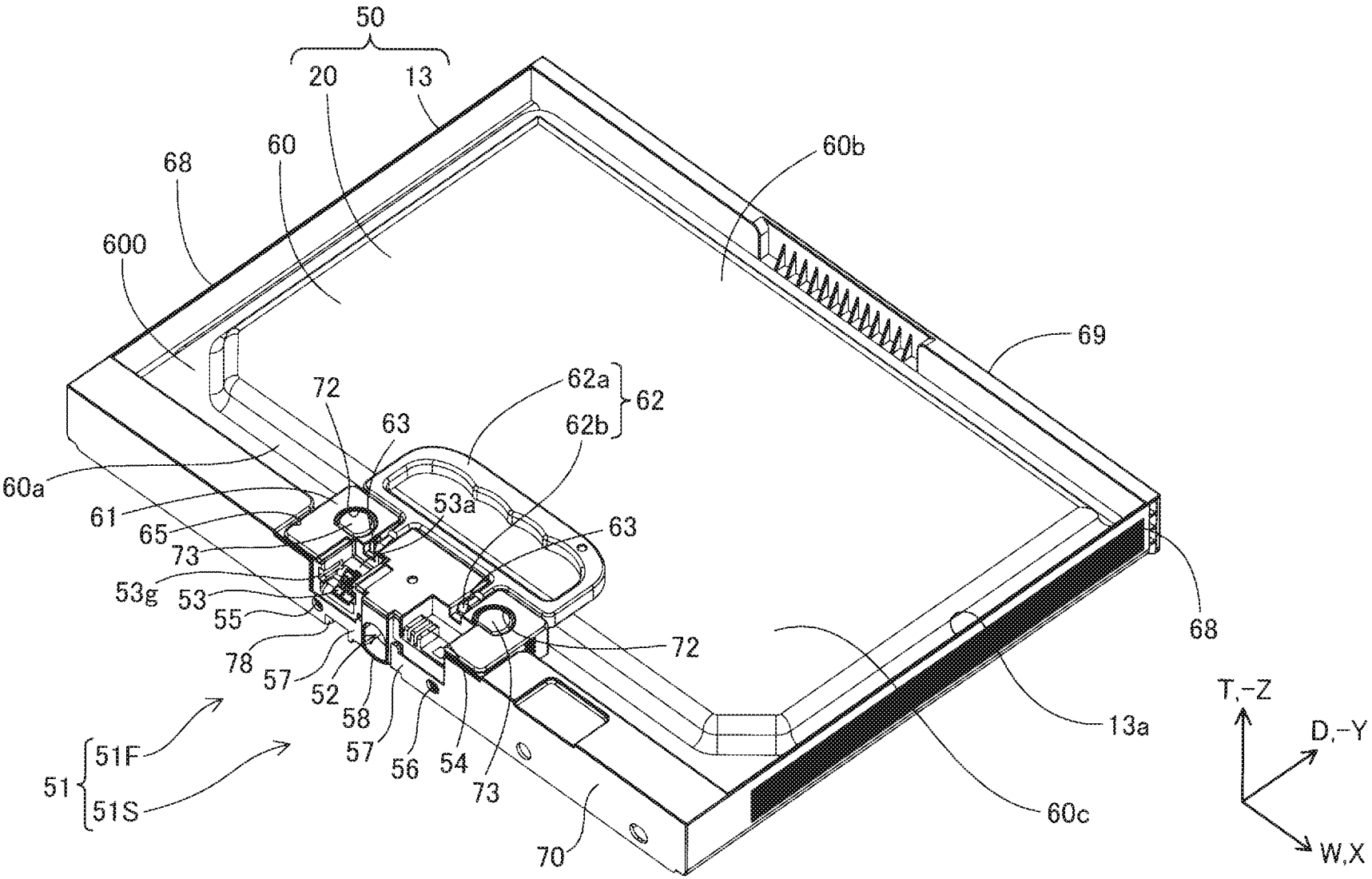
FIG. 4 is a perspective view of an attachment body that is attached to an attachment portion.

FIG. 4 is a perspective view of an attachment body 50 to be attached to the attachment portion 14. In the present embodiment, the attachment body 50 is constituted by the container 13 having a substantially rectangular parallelepiped external shape and the liquid container 20 that is mounted in the container 13. The container 13 can be referred to as a tray or a case as well.

A D direction, a T direction, and a W direction that are three directions that orthogonally intersect each other are shown in FIG. 4. In the present embodiment, the D direction is a direction extending along the Y direction shown in FIG. 1. The positive direction of the D direction is denoted as a +D direction, and the direction opposite to the +D direction is denoted as a −D direction. Also, a direction along which a size of the external shape of the liquid container 20 is the smallest is denoted as a T direction. The positive direction of the T direction is denoted as a +T direction, and the direction opposite to the +T direction is denoted as a −T direction. The direction orthogonal to the D direction and the T direction is denoted as a W direction. The positive direction of the W direction is denoted as a +W direction, and the direction opposite to the +W direction is denoted as a −W direction. In the present embodiment, the T direction is a direction extending along the Z direction, and the +T direction corresponds to the −Z direction. Also, the W direction is a direction extending along the X direction, and the +W direction corresponds to the +X direction. In a state in which the liquid container 20 is attached to the liquid ejection device 11, the D direction and the W direction are in a horizontal plane. Note that "horizontal" need only be substantially horizontal, and may include a plane that is inclined in a range of ±10 degrees relative to the horizontal plane.

The liquid container 20 is for supplying liquid to the liquid ejection device 11. The liquid container 20 includes a bag 60 and a connection member 61. The bag 60 is flexible. The bag 60 may have a pillow-type shape or a gusset-type shape. The bag 60 of the present embodiment is a pillow-type bag that is formed by stacking two rectangular films and joining the peripheral edges of the films to each other. The film that constitutes the bag 60 is made of a material that has flexibility and gas barrier properties. Examples of the material of the films constituting the bag 60 include polyethylene terephthalate (PET), nylon, polyethylene, and the like. Also, the film may be formed using a laminated structure in which a plurality of films made of these materials are laminated. In such a laminated structure, the outer layer may be made of PET or nylon that has excellent impact resistance, and the inner layer may be made of polyethylene that has excellent ink resistance, for example. Furthermore, a film including a layer acquired by vapor depositing aluminum or the like may be one constituent member of the laminated structure.

The bag 60 in the present embodiment, in a state in which liquid is contained, has a substantially rectangular parallelepiped shape. In the present embodiment, the size of the bag 60 along the W direction is larger than the size along the D direction and the size along the T direction. Also, in the present embodiment, the size of the bag 60 along the D direction is larger than the size along the T direction. The bag 60 includes a one end portion 60*a* and another end portion 60*b* that opposes the one end portion 60*a*. The one end portion 60*a* is located at an end of the bag 60 on the −D direction side, and the other end portion 60*b* is located at an end of the bag 60 on the +D direction side. The bag 60 includes, inside thereof, a liquid container 60*c* for containing liquid. In the present embodiment, ink, as the liquid, in which pigment as a sedimentary component is dispersed in a solvent is contained in the liquid container 60*c*. The bag 60 includes a sealed portion 600 on an outer peripheral side relative to the liquid container 60*c*. The sealed portion 600 is a portion in which a member constituting the face of the bag 60 on the +T direction side and a member constituting the face on the −T direction side are bonded together on their back face sides. Specifically, the sealed portion 600 is a portion in which a film constituting the face of the bag 60 on the +T direction side and a film constituting the face on the −T direction side are adhered together. The sealed portion 600 has a flat shape. Note that a "flat shape" need only be flat as a whole, and may be partially uneven.

The connection member 61 is attached to the one end portion 60*a* of the bag 60. In the present embodiment, the connection member 61 has a substantially rectangular parallelepiped shape. In the present embodiment, the size of the connection member 61 in the W direction is larger than the size in the D direction and the size in the T direction. Also, the size of the connection member 61 in the D direction is larger than the size in the T direction. In the present embodiment, the width of the connection member 61 along the W direction is smaller than the width of the bag 60 along the W direction. Therefore, the connection member 61 is attached to the center of the bag 60 in the width direction in the one end portion 60*a* of the bag 60. The connection member 61 includes a liquid outlet portion 52 for guiding out liquid inside the liquid container 60*c* to the liquid ejection device 11. The liquid outlet portion 52 can also be referred to as a "supply port". Also, the connection member 61 can also be referred to as an "adapter".

When the end of the attachment body 50 that is inserted first when the attachment body 50 is attached to the attachment portion 14 is denoted as a leading end, and the end on the side opposite to the leading end is denoted as a base end, the attachment body 50 includes the connection structure 51 in the leading end portion. The connection structure 51 includes a first connection structure 51F and a second connection structure 51S respectively on both sides of the liquid outlet portion 52 in the width direction.

The first connection structure 51F includes a connection terminal 53 that is arranged vertically upward of the liquid outlet portion 52. The connection terminal 53 is provided on a surface of a circuit board, for example, and the circuit board includes a memory that stores various types of information regarding the liquid container 20 (type of the liquid container 20, contained amount of liquid, and the like, for example).

The connection terminal 53 is arranged so as to face obliquely upward inside a recess 53*a* that is provided in a mode of being open upward and in the attachment direction. Also, guide recesses 53*g* that extend in the attachment direction are provided on both sides of the connection terminal 53 in the width direction. The guide projections 40*a* of the connection mechanism 29 shown in FIG. 2 are fitted into the guide recesses 53*g*.

The second connection structure 51S includes an identification portion 54 for preventing erroneous insertion that is arranged vertically upward of the liquid outlet portion 52. The identification portion 54 includes protrusions and recesses that are shaped so as to fit together with the block 44 of the connection mechanism 29 shown in FIG. 2.

The connection structure 51 includes first and second positioning holes 55 and 56, a bias receiver 57 that receives a biasing force of the biasing portion 47*c* shown in FIG. 2, and an insertion portion 58 that extends below the liquid outlet portion 52. The first and second positioning holes 55 and 56 are arranged side by side in the width direction sandwiching the liquid outlet portion 52 so as to be respectively included in the first and second connection structures 51F and 51S. The first positioning hole 55 included in the first connection structure 51F is a circular hole. In contrast, the second positioning hole 56 included in the second connection structure 51S is preferably a long hole having a substantially elliptical shape that is long in the width direction.

Figure 5:
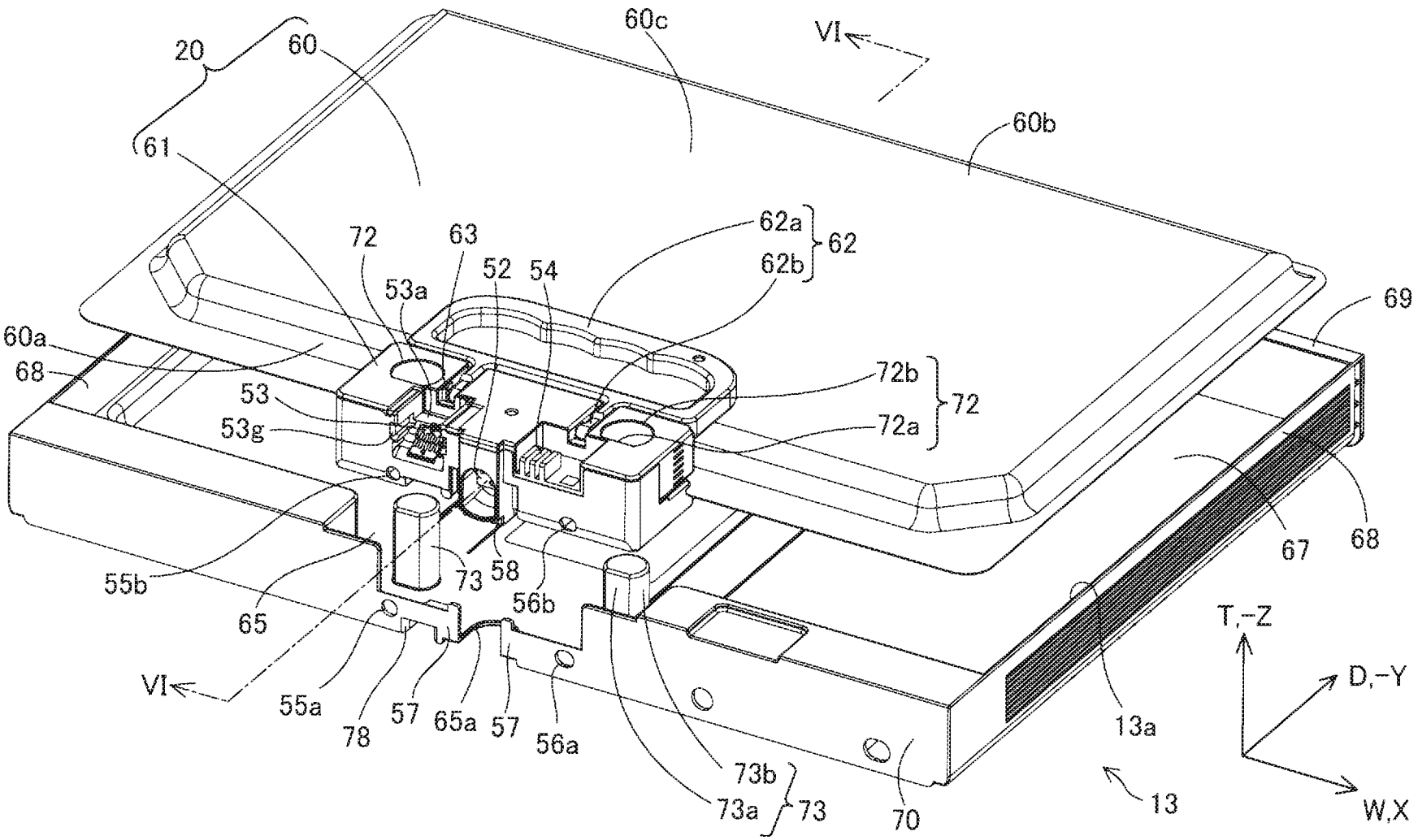
FIG. 5 is a perspective view of a liquid container and a container that constitute the attachment body.

FIG. 5 is a perspective view of the liquid container 20 and the container 13 that constitute the attachment body 50. A notch 65*a* that engages with the insertion portion 58 provided in the connection member 61 of the liquid container 20 is formed at the leading end of the container 13. Also, first and second holes 55*a* and 56*a* are respectively formed on both sides of the notch 65*a* in the width direction, and first and second holes 55*b* and 56*b* are formed at the leading end of the connection member 61. When the liquid container 20 is mounted in the container 13, the first holes 55*a* and 55*b* and the second holes 56*a* and 56*b* respectively align with each other in the depth direction, and the first holes 55*a* and 55*b* constitute the first positioning hole 55, and the second holes 56*a* and 56*b* constitute the second positioning hole 56.

A handle 62 is attached to the connection member 61. The handle 62 is constituted by a member that is different from the connection member 61, and is movable relative to the connection member 61. Specifically, the handle 62 can move by pivoting about a rotation shaft 63 provided in the connection member 61. In the following description, it is assumed that the handle 62 is not included in the "connection member 61".

The handle 62 includes a grip 62*a* that is gripped by a user. The grip 62*a* is located on the bag 60 side, in the depth direction, that is distant from the connection member 61 relative to the shaft 62*b* that is shaft-supported by the pivot shaft 63. Also, the handle 62 can pivot between a first orientation in which the grip 62*a* and the pivot shaft 63 are at the same height or the grip 62*a* is located below the pivot shaft 63 and a second orientation in which the grip 62*a* is located higher than the pivot shaft 63.

The container 13 includes, in the leading end portion, an engagement receiver 65 with which the connection member 61 of the liquid container 20 can engage. The connection member 61 includes the connection terminal 53, the recess 53*a*, the guide recesses 53*g*, the identification portion 54, and the first and second holes 55*b* and 56*b*. The engagement receiver 65 of the container 13 includes the bias receiver 57 and the first and second holes 55*a* and 56*a*. The connection member 61 is located at the center of the leading end portion of the container 13 when engaged with the engagement receiver 65.

The container 13 includes a bottom plate 67 that constitutes a bottom face, side plates 68 that extend vertically upward from both ends of the bottom plate 67 in the width direction, a front plate 69 that extends vertically upward from a base end of the bottom plate 67, and a leading plate 70 that extends vertically upward from a leading end of the bottom plate 67. The leading plate 70 is formed to be thicker than the front plate 69 and the side plates 68, and has a recess at a central portion that corresponds to the engagement receiver 65.

In the container 13, the bottom plate 67, the side plates 68, the front plate 69, and the leading plate 70 constitute a main body that includes an accommodation space for accommodating the liquid container 20. The container 13 includes an opening 13*a* through which the liquid container 20 is inserted and removed to and from the accommodation space. In the present embodiment, the opening 13*a* of the container 13 is open vertically upward, which is a direction different from the attachment direction in which the container 13 advances when being attached to the attachment portion 14.

The connection member 61 of the liquid container 20 is provided with a plurality of guided portions 72 having a substantially round-hole shape that are formed so as to pass through the connection member 61 in a guiding direction. In the present embodiment, two guided portions 72 are formed to be aligned in the width direction. Also, the engagement receiver 65 of the container 13 is provided with a plurality of guiding portions 73 having a substantially columnar shape that protrude in the guiding direction from the bottom plate 67. In the present embodiment, two guiding portions 73 are formed so as to be aligned in the width direction. Note that the guiding direction is a direction orthogonal to the bottom plate 67.

The guiding portions 73 provided in the container 13 guide the guided portions 72 provided in the connection member 61 in the guiding direction. On the other hand, the guided portions 72 provided in the connection member 61 are guided by the guiding portions 73 provided in the container 13 in the guiding direction.

In the present embodiment, each guiding portion 73 has an approximately semi-cylindrically protruded shape, and the side face, extending along the guiding direction, of the guiding portion 73 includes a planar first restriction portion 73*a* located on the leading end side, and a first curved face portion 73*b* on the base end side relative to the restriction portion 73*a*.

Also, each guided portion 72 is formed to have a shape that includes a second restriction portion 72*a* and a second curved face portion 72*b* so as to match the shape of the guiding portion 73. The planar restriction portions 72*a* and 73*a* restrict escape and rotation of the liquid container 20 when mounted in the container 13.

Coupling of the connection structure 51 included in the attachment body 50 to the connection mechanism 29 will be described with reference to FIGS. 2 and 4. When the attachment body 50 is inserted into the accommodation space and the leading end approaches the connection mechanism 29, first, the leading ends of the first and second positioning protrusions 45 and 46 whose projection length in the removal direction is long respectively enter the first and second positioning holes 55 and 56 of the attachment body 50 and engage therewith, and as a result, the movement of the attachment body 50 in the width direction is restricted. Since the second positioning hole 56 is an elliptical long hole that extends in the width direction, the first positioning protrusion 45 that enters the circular first positioning hole 55 serves as the reference for positioning.

When the attachment body 50 advances in the depth direction after the first and second positioning protrusions 45 and 46 respectively have engaged with the first and second positioning holes 55 and 56, the bias receiver 57 comes into contact with the pressing portion 47*b* and receives a biasing force of the biasing portion 47*c*, and the liquid outlet portion 52 of the liquid container 20 is coupled to the liquid introduction needle 32. In this way, in the present embodiment, the positioning of the attachment body 50 in the width direction is performed using the first and second positioning protrusions 45 and 46 before the liquid introduction needle 32 is coupled to the liquid outlet portion 52.

When the attachment body 50 is inserted to a correct position, the identification portion 54 is properly fits with the block 44 of the connection mechanism 29. In contrast, when a different attachment body 50 is attempted to be attached, because the identification portion 54 does not fit with the block 44, the attachment body 50 cannot move further in the depth direction, and therefore, erroneous attachment can be prevented.

Also, when the attachment body 50 advances in the attachment direction, the terminal unit 40 enters the inside of the recess 53*a* of the attachment body 50, the position of the terminal unit 40 is adjusted by the guide recesses 53*g* respectively guided to the guide projections 40*a*, and the terminal unit 40 comes into contact with the connection terminal 53. With this, the connection terminal 53 is electrically coupled to the terminal unit 40, and information is transmitted and received between the circuit board and the control device 42. As a result of arranging the first positioning hole 55, which serves as a reference for positioning, in the first connection structure 51F, of the first connection structure 51F and the second connection structure 51S, that includes the connection terminal 53, the connection terminal 53 and the terminal unit 40 can be properly coupled.

When the liquid outlet portion 52 of the liquid container 20 is coupled to the liquid introduction needle 32 to achieve a state in which liquid can be supplied, and the connection terminal 53 comes into contact with and electrically coupled to the terminal unit 40, the coupling of the connection structure 51 to the connection mechanism 29 is complete.

Figure 6:
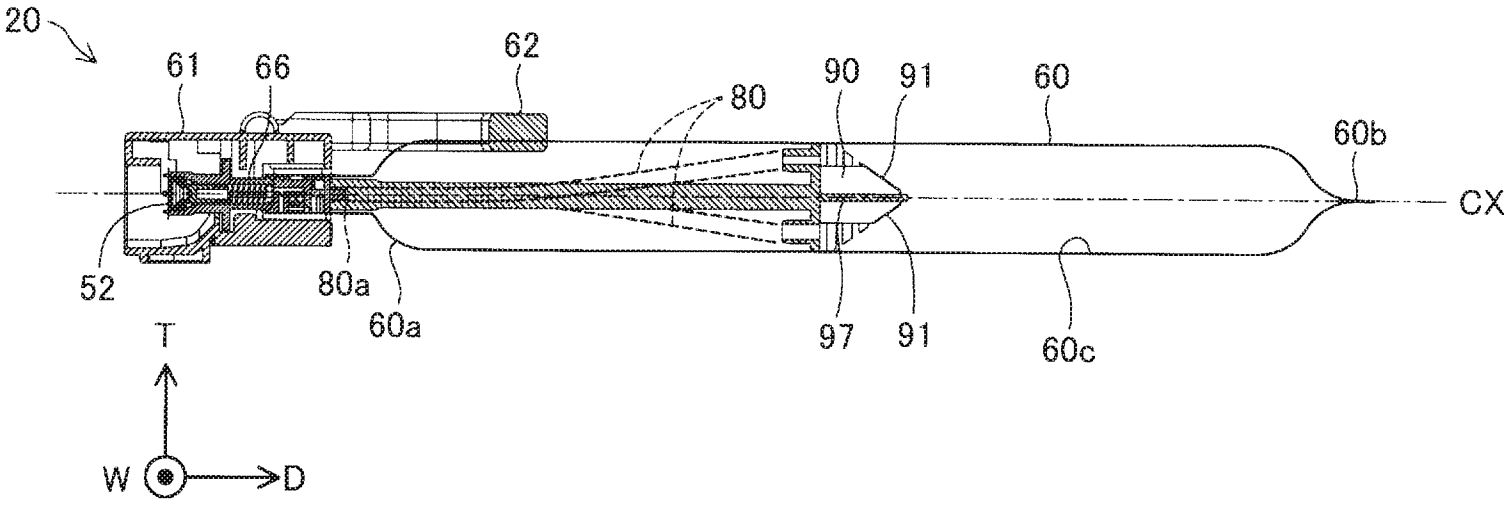
FIG. 6 is a cross-sectional view of the liquid container taken along line VI-VI in FIG. 5.

FIG. 6 is a schematic cross-sectional view of the liquid container 20 taken along line VI-VI in FIG. 5. A central axis CX of the cylindrical liquid outlet portion 52 is shown in FIG. 6. The liquid container 20 includes, inside the connection member 61, the liquid outlet member 66 that integrally includes the liquid outlet portion 52. The liquid outlet member 66 is attached to the one end portion 60*a* of the bag 60. The liquid container 20 includes, inside the liquid container 60*c* provided in the bag 60, liquid outlet tubes 80 and a spacer member 90. The liquid outlet tubes 80 are elastic tubes formed by elastomer, for example. The liquid outlet tubes 80 each include, inside the liquid container 60*c*, a base end 80*a* coupled to the liquid outlet member 66. The liquid outlet tubes 80 extend, inside the liquid container 60*c*, from the liquid outlet member 66 toward the other end portion 60*b*. A channel for bringing the liquid outlet tubes 80 and the liquid outlet portion 52 into communication is formed inside the liquid outlet member 66. The liquid outlet member 66 fixes the liquid outlet portion 52, the bag 60, the liquid outlet tube 80, and the spacer member 90 to the connection member 61.

The spacer member 90 is a structure for defining a region having a certain volume in the bag 60. The spacer member 90 is made of a synthetic resin such as polyethylene or polypropylene. The spacer member 90 has a portion positioned on the +D direction side relative to the liquid outlet tubes 80. Also, the spacer member 90 is provided at a position intersecting a TD plane that passes through the central axis CX of the liquid outlet portion 52. The TD plane refers to a plane extending in the T direction and the D direction. The spacer member 90 has, on the +D direction side, inclined faces 91 inclined such that the dimension in the T direction of the spacer member 90 increases from the +D direction side toward the −D direction side. In the present embodiment, the spacer member 90 has inclined faces 91 respectively on the +T direction side and the −T direction side relative to the central axis CX. Therefore, the spacer member 90 has a pointed shape toward the +D direction side, when viewed from the W direction. Note that in the present embodiment, a "face" includes not only a face constituted only by a flat face, but also a face on which a groove, a recessed portion or the like is formed, a face on which a protrusion or a projection is formed, and a virtual face surrounded by a frame. In other words, as long as the face can be grasped as being a "face" overall, a certain region occupied by the face may include a recession, a projection, and a through hole.

In an orientation in which the liquid container 20 is attached to the liquid ejection device 11, at least one of the lowermost portion and the uppermost portion of the spacer member 90 comes into contact with the internal face of the bag 60. In the present embodiment, as shown in FIG. 6, both the lowermost portion and the uppermost portion of the spacer member 90 are in contact with the internal face of the bag 60. Hereinafter, the orientation of the liquid container 20 when being attached to the liquid ejection device 11 is referred to as an "attached orientation". In the present embodiment, in the attached orientation, the center between the heights of the lowermost portion and the uppermost portion of the spacer member 90 is the same as the height of the central axis CX of the liquid outlet portion 52.

Figure 7:
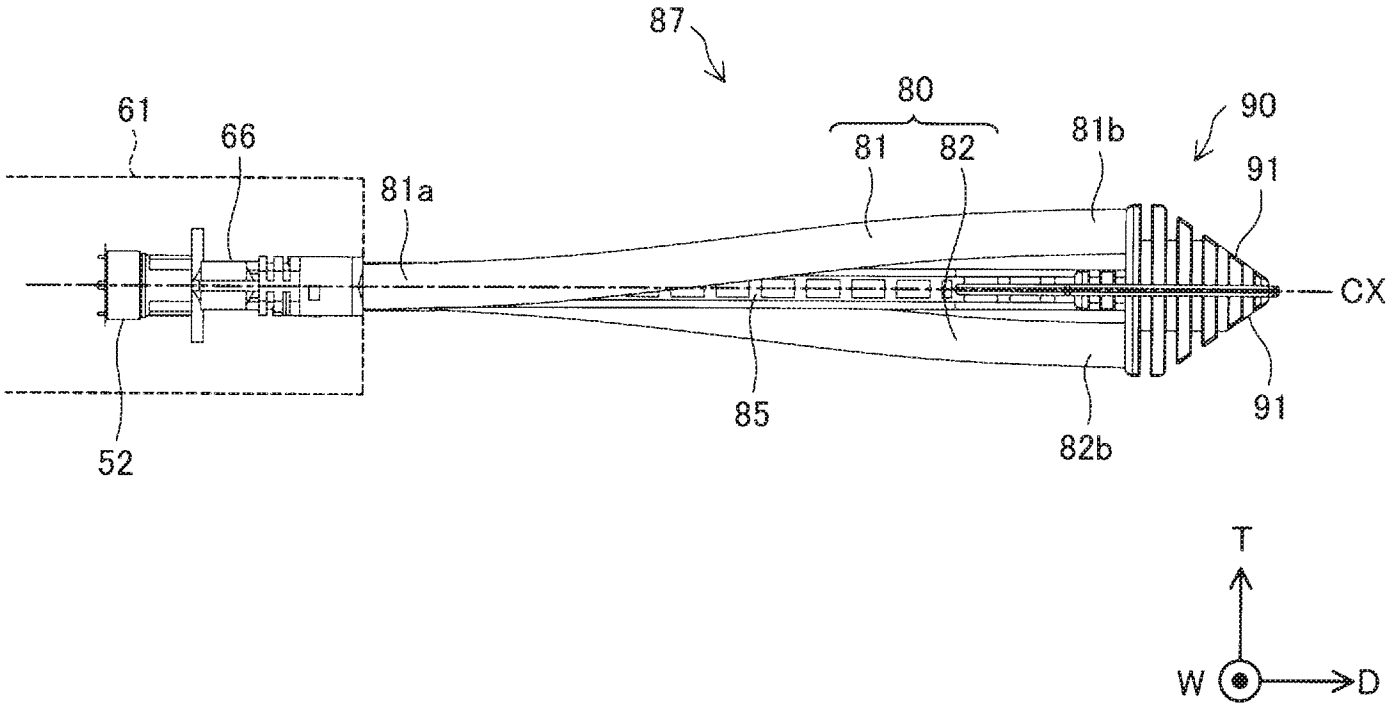
FIG. 7 is a side view of a spacer member and a liquid outlet tube.
Figure 8:
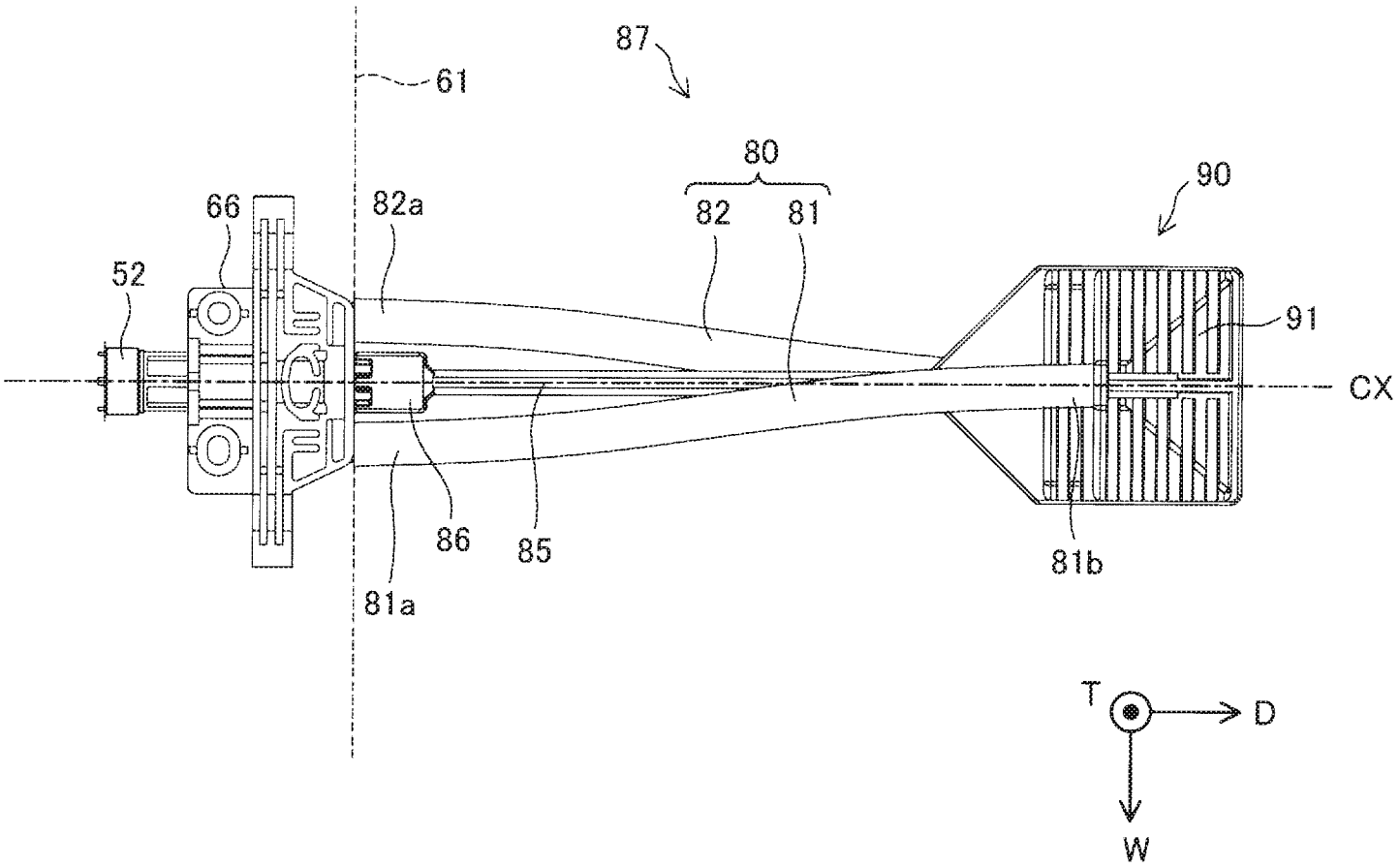
FIG. 8 is a plan view of the spacer member and the liquid outlet tube.
Figure 13:
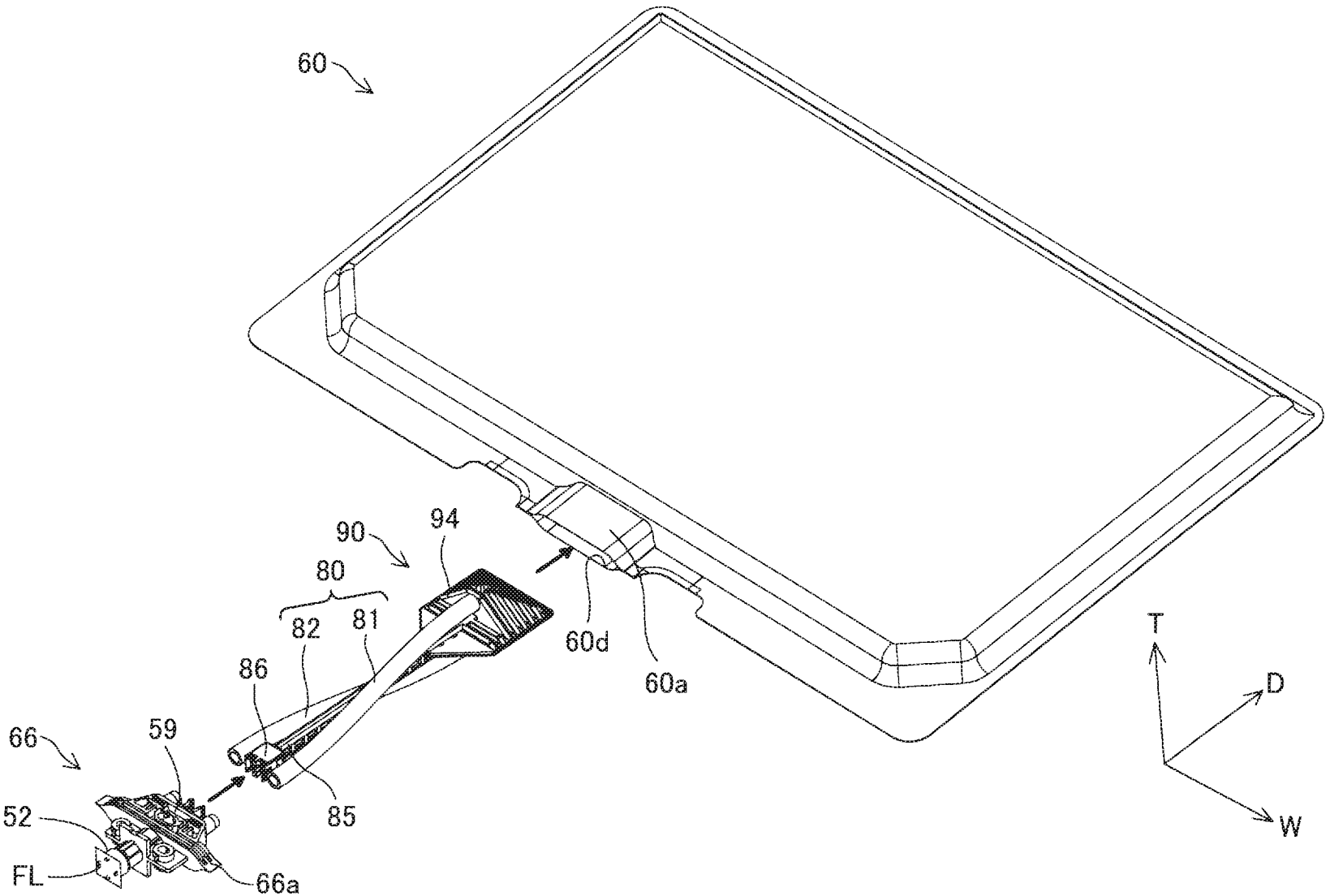
FIG. 13 is a first exploded perspective view of a portion of the liquid container.

FIG. 7 is a side view of the spacer member 90 and the liquid outlet tubes 80. FIG. 8 is a plan view of the spacer member 90 and the liquid outlet tubes 80. The liquid outlet tubes 80 are configured to extend in the horizontal direction inside the liquid container 60*c* from the liquid outlet portion 52, in the attachment orientation. Also, in the present embodiment, the spacer member 90 is fixed to the liquid outlet member 66 by a rod-like coupling member 85. In the present embodiment, the coupling member 85 is integrally coupled to the spacer member 90. In the following, the coupling member 85 and the spacer member 90 are collectively referred to as an internal rigid member 87. The internal rigid member 87 has the function of stabilizing the orientation of the bag 60 relative to the connection member 61, and securing a channel of liquid inside the bag 60. The internal rigid member 87 is coupled to the liquid outlet member 66 and extends in the +D direction from the liquid outlet member 66 inside the liquid container 60*c*. A second locking portion 86 that is locked and fixed to a claw 59 that is shown in FIG. 13 and is provided in a face of the liquid outlet member 66 on the +D direction side is provided at the end, on the −D direction side, of the coupling member 85 that constitutes the internal rigid member 87.

In the present embodiment, the liquid container 20 has a first channel portion 81 and a second channel portion 82 as the liquid outlet tubes 80. That is, the liquid container 20 includes two liquid outlet tubes 80. In the present embodiment, the first channel portion 81 and the second channel portion 82 have the same length. The first channel portion 81 has a first base end 81*a* that is coupled to the liquid outlet member 66 and a first leading end 81*b* for introducing liquid in the liquid container 60*c* into the first channel portion 81. The second channel portion 82 has a second base end 82*a* that is coupled to the liquid outlet member 66 and a second leading end 82*b* for introducing liquid in the liquid container 60*c* into the second channel portion 82. Moreover, as shown in FIG. 7, in the attached orientation, the first leading end 81*b* is positioned above the second leading end 82*b*. As shown in FIG. 8, the above-described second locking portion 86 is arranged so as to be sandwiched between the first base end 81*a* of the first channel portion 81 and the second base end 82*a* of the second channel portion 82 in the horizontal direction. Note that in other embodiments, the liquid container 20 may include three or more liquid outlet tubes 80.

As shown in FIGS. 7 and 8, in the present embodiment, in the attached orientation, the first base end 81*a* of the first channel portion 81 and the second base end 82*a* of the second channel portion 82 are aligned in the horizontal direction, and the first leading end 81*b* of the first channel portion 81 and the second leading end 82*b* of the second channel portion 82 are aligned in the vertical direction. Therefore, liquid suctioned to the first channel portion 81 and liquid suctioned to the second channel portion 82 are mixed in the liquid outlet member 66 after the flow is changed from a state of flowing side by side in the vertical direction into a state of flowing side by side in the horizontal direction, and the mixed liquid is led out from the liquid outlet portion 52 to the liquid ejection device 11. Note that in other embodiments, it is possible to adopt a mode in which the first base end 81*a* and the second base end 82*a* are aligned in the vertical direction, and the first leading end 81*b* and the second leading end 82*b* are aligned in the horizontal direction, a mode in which the first base end 81*a* and the second base end 82*a* are aligned in the vertical direction, and the first leading end 81*b* and the second leading end 82*b* are also aligned in the vertical direction, and a mode in which the first base end 81*a* and the second base end 82*a* are aligned in the horizontal direction, and the first leading end 81*b* and the second leading end 82*b* are also aligned in the horizontal direction.

Figure 9:
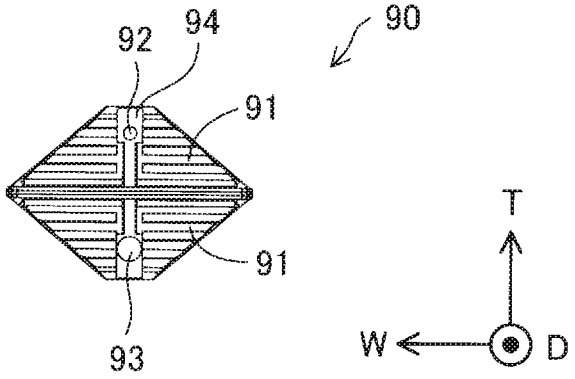
FIG. 9 is a front view of the spacer member.
Figure 10:
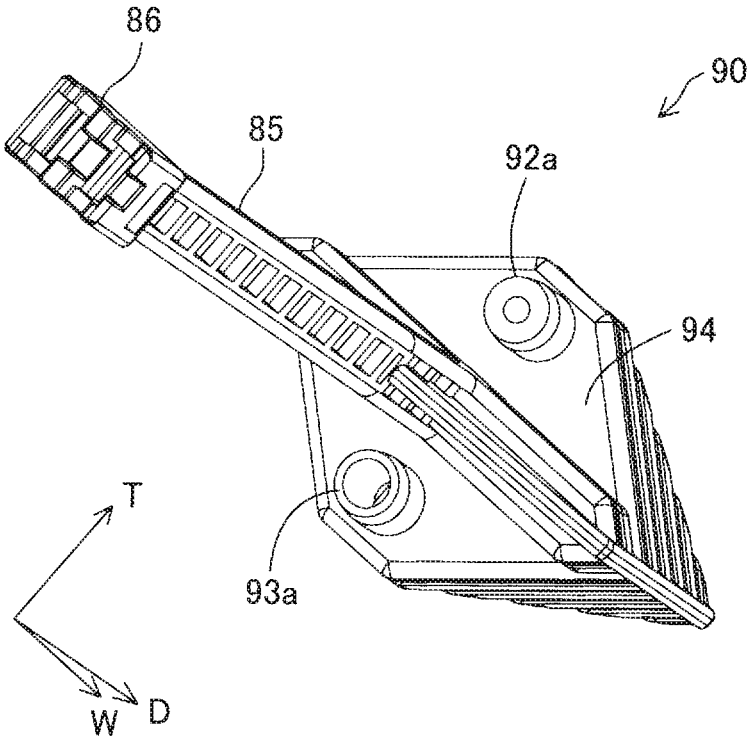
FIG. 10 is a perspective view of a rear face side of the spacer member.

FIG. 9 is a front view of the spacer member 90. FIG. 10 is a perspective view of a rear face side of the spacer member 90. The spacer member 90 includes a first introduction port 92 and a second introduction port 93. The first introduction port 92 is an opening for introducing liquid on a relatively upper side of the liquid container 60*c* to the inside of the first channel portion 81. The second introduction port 93 is an opening for introducing liquid on a relatively lower side of the liquid container 60*c* to the inside of the second channel portion 82. The spacer member 90 includes a rear face member 94 that is parallel to the TW plane at a position at which the dimension of the spacer member 90 in the T direction is largest. The rear face member 94 has an approximately hexagonal shape whose upper and bottom sides extends horizontally. The first introduction port 92 and the second introduction port 93 are provided in this rear face member 94. In the present embodiment, the inner diameter of the first introduction port 92 is smaller than the inner diameter of the second introduction port 93. That is, the inner diameter of the second introduction port 93 is larger than the inner diameter of the first introduction port 92. Therefore, the second introduction port 93 positioned below the first introduction port 92 suctions liquid in the liquid container 60*c* more easily. Note that as shown in FIG. 9, in the present embodiment, the spacer member 90 has an inclined face not only on the +D direction side but also on the +W direction side and the −W direction side.

The first introduction port 92 and the second introduction port 93 faces in the +D direction. Also, the first introduction port 92 and the second introduction port 93 are provided at positions that are symmetrical in the T direction relative to the central axis CX of the liquid outlet portion 52 shown in FIG. 6. The first introduction port 92 is provided above the central axis CX, and the second introduction port 93 is provided below the central axis CX.

Figure 11:
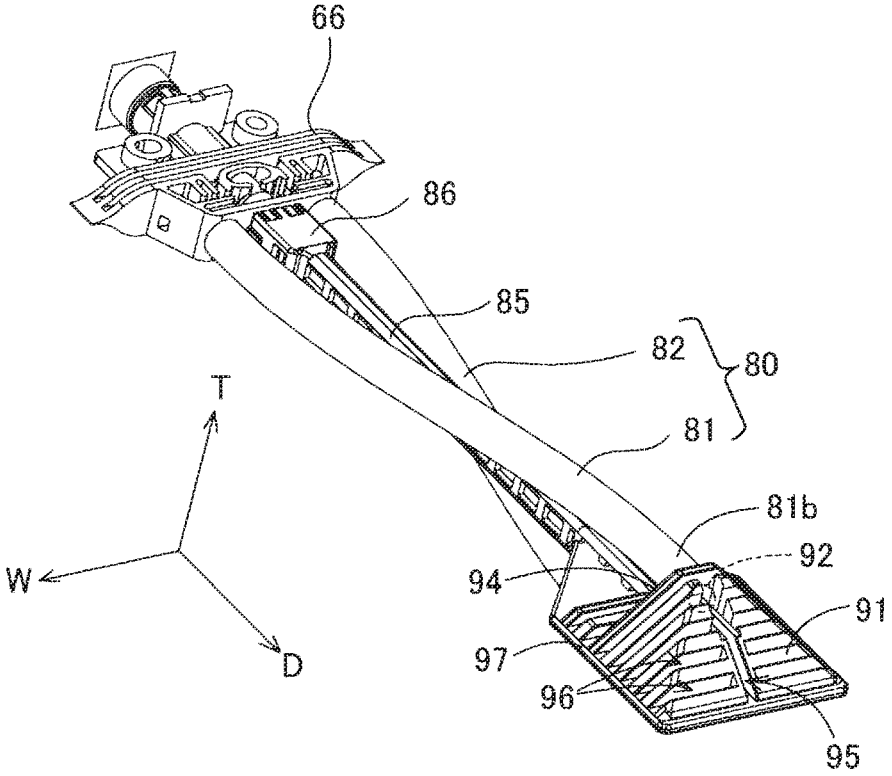
FIG. 11 is a first perspective view of the spacer member and the liquid outlet tube.

FIG. 11 is a first perspective view of the spacer member 90 and the liquid outlet tubes 80. The first leading end 81*b* of the first channel portion 81 of the liquid outlet tubes 80 is coupled to the first introduction port 92. Specifically, a tube-shaped first connection tube 92*a* that is shown in FIG. 10 and is in communication with the first introduction port 92 is provided in a face of the rear face member 94 on the −D direction side, and the first connection tube 92*a* is inserted into the first leading end 81*b* of the first channel portion 81, and as a result, the first leading end 81*b* of the first channel portion 81 is coupled to the first introduction port 92.

Figure 12:
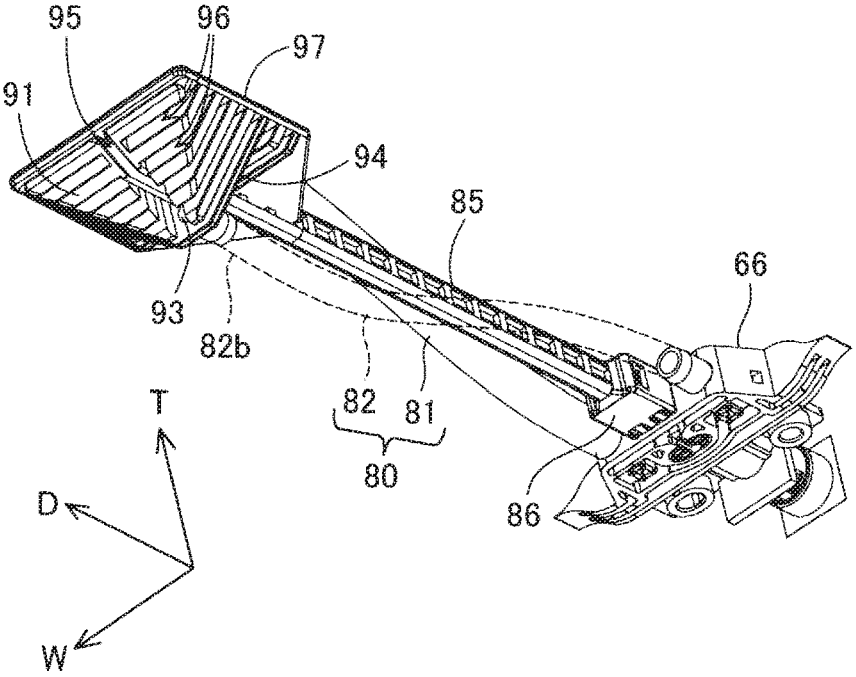
FIG. 12 is a second perspective view of the spacer member and the liquid outlet tube.

FIG. 12 is a second perspective view of the spacer member 90 and the liquid outlet tubes 80. The second leading end 82*b* of the second channel portion 82 of the liquid outlet tubes 80 is coupled to the second introduction port 93. Specifically, a tube-shaped second connection tube 93*a* that is shown in FIG. 10 and is in communication with the second introduction port 93 is provided on the face of the rear face member 94 on the −D direction side, and the second connection tube 93*a* is inserted into the second leading end 82*b* of the second channel portion 82, and as a result, the second leading end 82*b* of the second channel portion 82 is coupled to the second introduction port 93. In the present embodiment, the lengths of the second connection tube 93*a* and the first connection tube 92*a* in the D direction are the same.

As shown in FIGS. 11 and 12, in the present embodiment, the first leading end 81*b* of the first channel portion 81 and the second leading end 82*b* of the second channel portion 82 are fixed to the spacer member 90. In contrast, in other embodiments, at least one of the first leading end 81*b* of the first channel portion 81 and the second leading end 82*b* of the second channel portion 82 may be separated from the spacer member 90. In this case, the first leading end 81*b* or the second leading end 82*b* that is separated from the spacer member 90 may directly introduce liquid, without the spacer member 90 being interposed therebetween.

As shown in FIGS. 11 and 12, the spacer member 90 is provided with groove-shaped first channels 95 and second channels 96. The first channels 95 are channels for allowing liquid to flow from the +D direction side to the first introduction port 92 and the second introduction port 93 located in the −D direction. The second channels 96 are channels for allowing liquid to flow in a direction intersecting the D direction. In the present embodiment, a plurality of second channels 96 are formed. The second channels 96 are constituted by forming grooves extending vertically from the inclined faces 91 of the spacer member 90 along the W direction. Note that the second channels 96 may be formed so as to allow liquid to flow in a direction intersecting both the W direction and the D direction. Also, in other embodiments, at least one of the first channels 95 and the second channel 96 can be omitted.

In the present embodiment, the spacer member 90 is provided with a plate-like partition 97 that extends along the horizontal plane. The partition 97 is provided at a position between the first leading end 81*b* and the second leading end 82*b*, namely, a position between the first introduction port 92 and the second introduction port 93 in the T direction. In the present embodiment, the central axis CX of the liquid outlet portion 52 passes through the partition 97. In other words, in the present embodiment, the partition 97 is provided horizontally at the center of the liquid container 60*c*. It can also be said that the plurality of second channels 96 are formed by providing a plurality of ribs on the partition 97. Note that in other embodiments, the partition 97 may be omitted.

Figure 14:
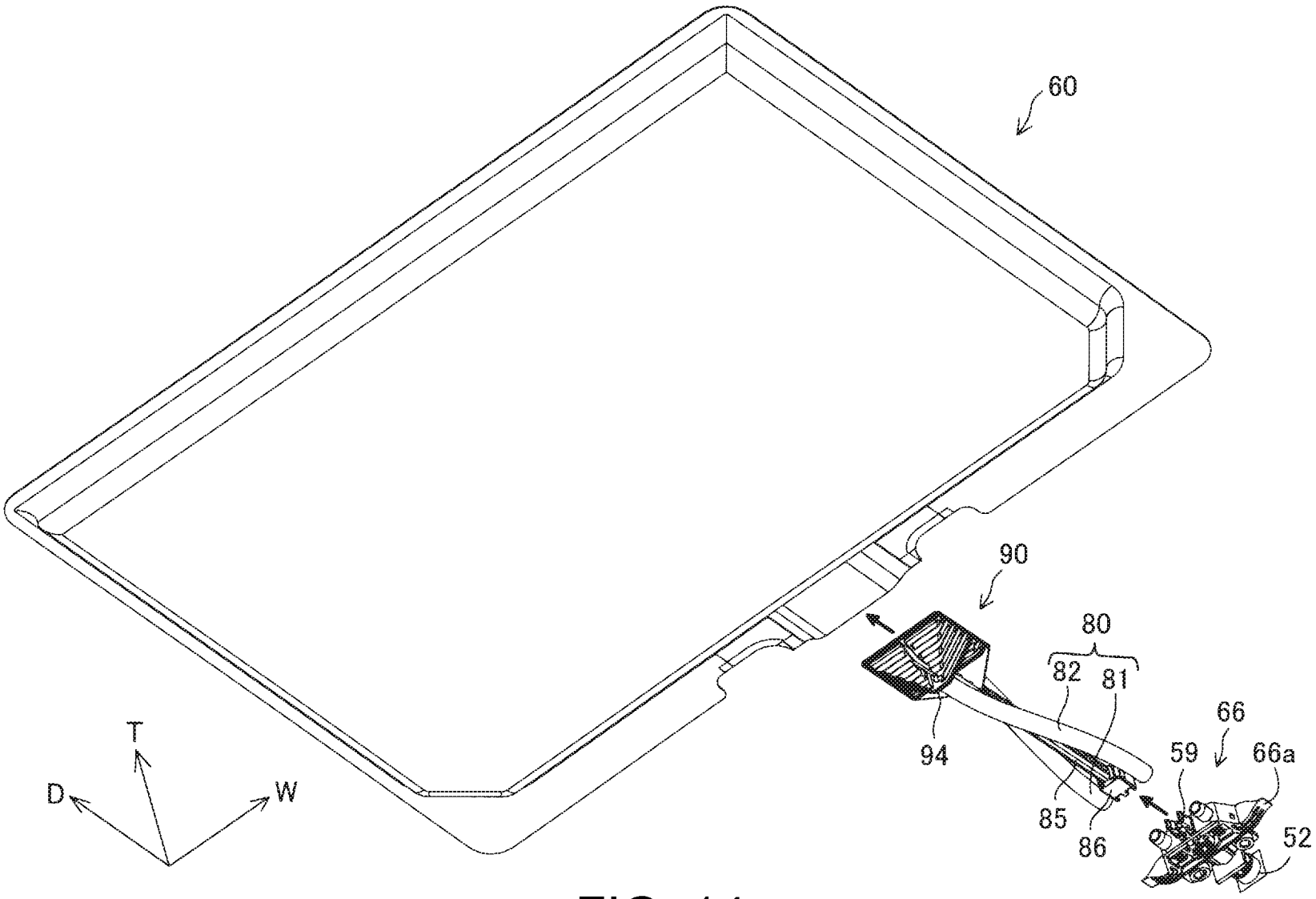
FIG. 14 is a second exploded perspective view of the portion of the liquid container.

FIG. 13 is a first exploded perspective view of a portion of the liquid container 20. FIG. 14 is a second exploded perspective view of the portion of the liquid container 20. When the liquid container 20 is manufactured, first, the second locking portion 86 provided in the coupling member 85 is coupled to the claw 59 provided in the liquid outlet member 66, and as a result, the spacer member 90 is fixed to the liquid outlet member 66. Then, the liquid outlet tubes 80 including the first channel portion 81 and the second channel portion 82 are coupled to the spacer member 90 and the liquid outlet member 66. The liquid outlet member 66 to which the spacer member 90 and the liquid outlet tubes 80 have been coupled is inserted, from the spacer member 90 side, into the inside of the bag 60 that is provided with an opening portion 60*d*, in advance, on the one end portion 60*a* side through the opening portion 60*d*. After the spacer member 90 and the liquid outlet tubes 80 have been inserted into the bag 60, the opening portion 60*d* of the bag 60 is adhered to and joined to an adhesion portion 66*a* that is provided at the outer periphery of the liquid outlet member 66. The adhesion portion 66*a* is a part at which the outer periphery of the liquid outlet member 66 is largest. The dimension of the inner periphery of the opening portion 60*d* is larger than or equal to the dimension of the outer periphery of the adhesion portion 66*a* of the liquid outlet member 66. Also, the dimension of the outer periphery of the adhesion portion 66*a* of the liquid outlet member 66 is larger than the dimension of the outer periphery of the rear face member 94 that has the largest outer periphery in the spacer member 90. Accordingly, in the present embodiment, the spacer member 90 that is inserted into the bag 60 before the liquid outlet member 66 has a smaller outer periphery than the liquid outlet member 66, and thus the spacer member 90 can be easily inserted into the bag 60 when the liquid container 20 is manufactured. Therefore, it is possible to suppress damage due to the bag 60 coming into excessive contact with the spacer member 90 during manufacturing. In the following, the bag 60 into which the spacer member 90 and the liquid outlet tubes 80 are inserted, and in which the opening portion 60*d* is adhered to the adhesion portion 66*a* of the liquid outlet member 66 is referred to as a "bag unit 60*u*".

Figure 15:
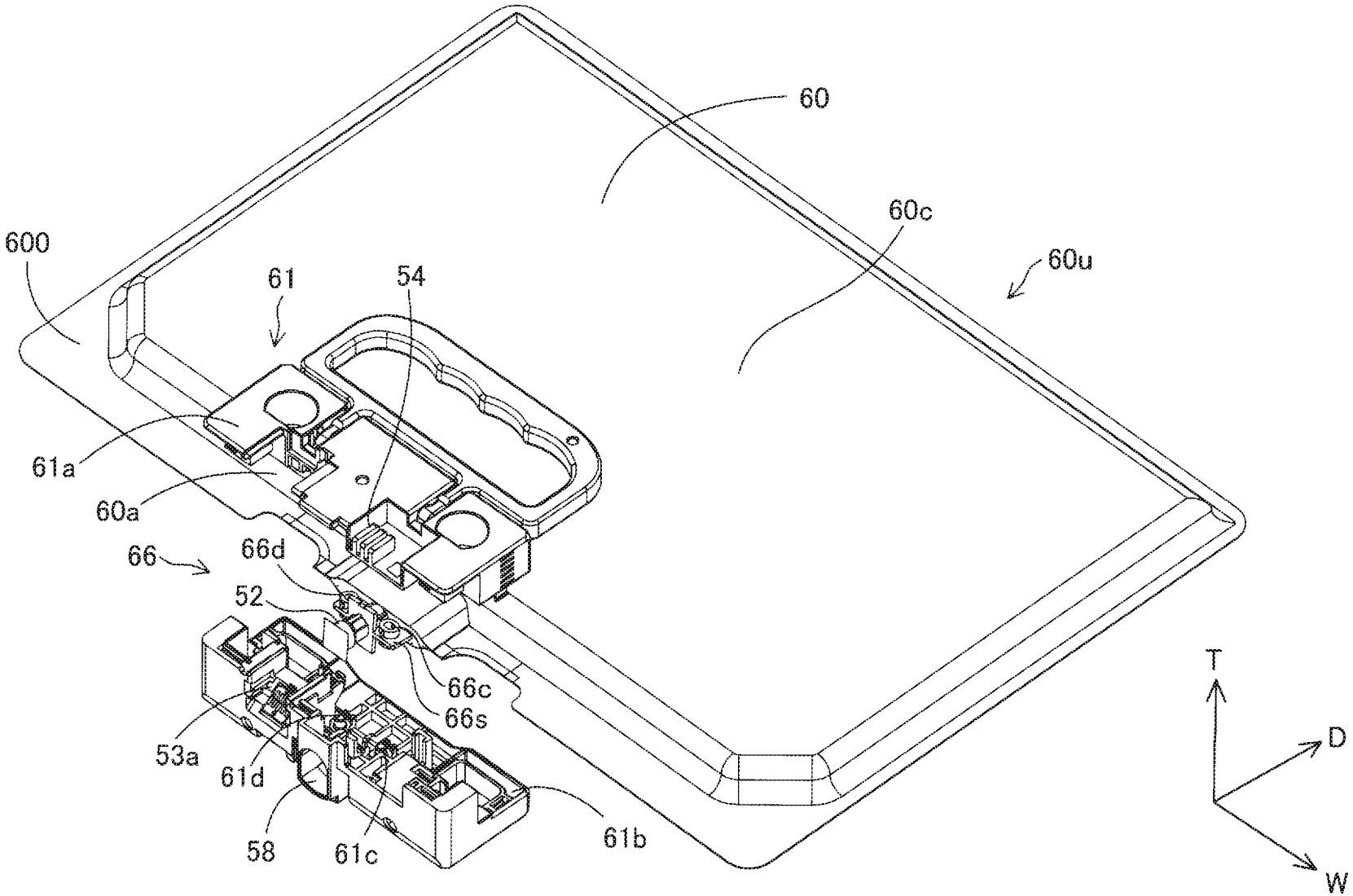
FIG. 15 is an exploded perspective view of the connection member.

FIG. 15 is an exploded perspective view of the connection member 61. The connection member 61 can be divided in the T direction, and includes a cover member 61*a* and a bottom member 61*b*. The bag unit 60*u* is fixed to the connection member 61 by sandwiching the end portion of the bag unit 60*u* on the −D direction side by the cover member 61*a* and the bottom member 61*b* from the +T direction side and the −T direction side.

The identification portion 54 is mainly formed in the cover member 61*a*. The insertion portion 58 and the recess 53*a* are mainly formed in the bottom member 61*b*. In the present embodiment, the bottom member 61*b* is provided with a first protrusion 61*c* and a second protrusion 61*d* that protrude in the +T direction. The first protrusion 61*c* and the second protrusion 61*d* are provided at positions that sandwich the insertion portion 58 in the W direction. A first through hole 66*c* and a second through hole 66*d* are provided in a fixing portion 66*s*, of the liquid outlet member 66, that is provided at a portion that exposes in the −D direction from the bag 60, at positions that sandwich the liquid outlet portion 52. The first protrusion 61*c* is inserted into the first through hole 66*c*, and the second protrusion 61*d* is inserted into the second through hole 66*d*. A portion of the end portion of the bag 60 on the −D direction side is sandwiched between the cover member 61*a* and the bottom member 61*b* along with the fixing portion 66*s* of the liquid outlet member 66. With such a structure, the connection member 61 is attached to the one end portion 60*a* of the bag 60 so as to cover the liquid outlet member 66 and the portion of the one end portion 60*a* of the bag 60 from the outside.

Figure 16:
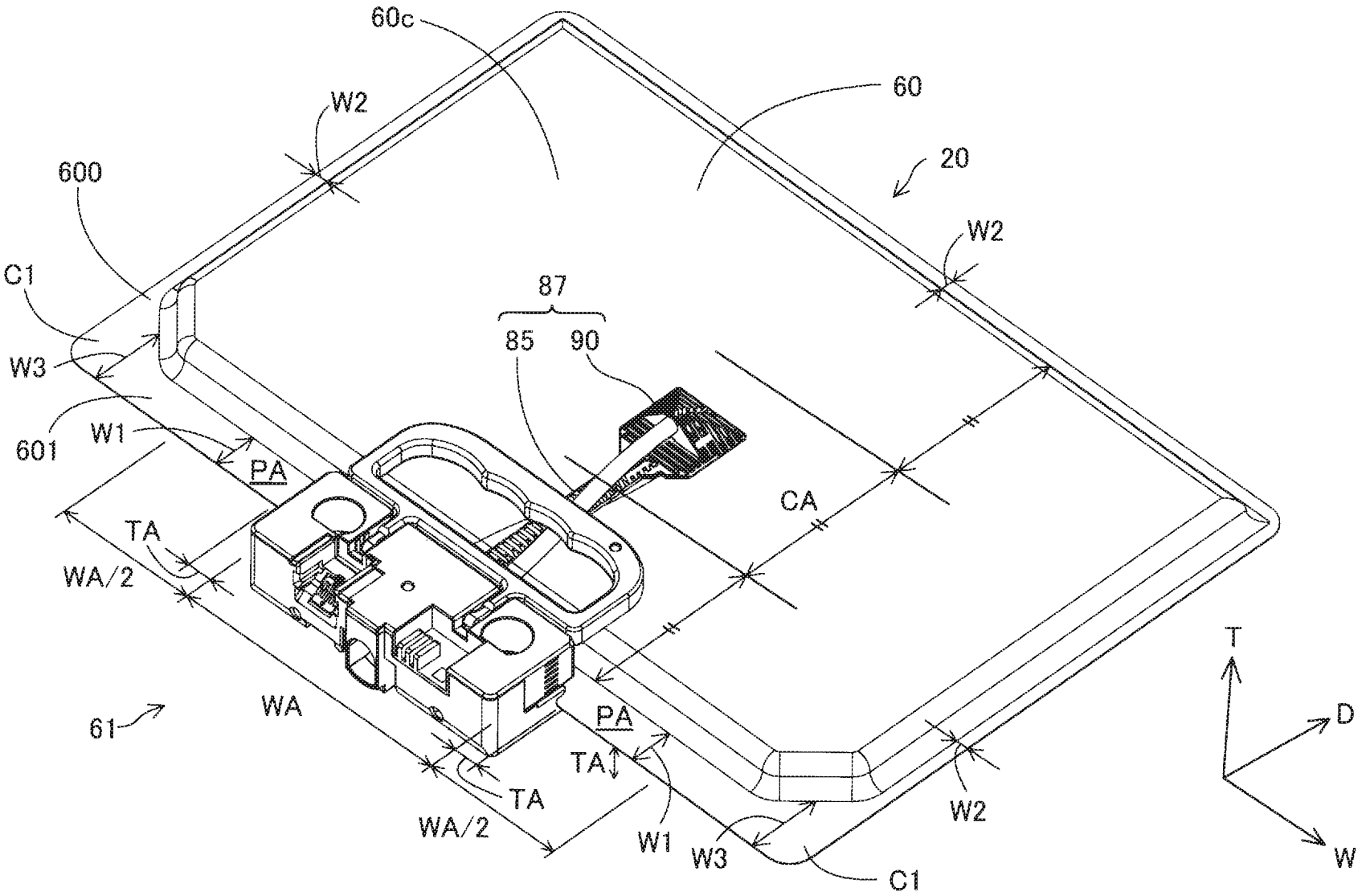
FIG. 16 is a diagram illustrating a shape of a bag and the position of an internal rigid member.

FIG. 16 is a diagram illustrating the shape of the bag 60 and the position of the internal rigid member 87. In FIG. 16, the internal rigid member 87 is illustrated so as to be superimposed on the bag 60, for convenience of description. The bag 60 includes the sealed portion 600 at the periphery of the liquid container 60*c*, as described above. In the present embodiment, the sealed portion 600 is formed on the +D direction side, the −D direction side, the +W direction side, and the −W direction side of the liquid container 60*c*. That is, the sealed portion 600 is formed along the four sides of the bag 60. Note that the sealed portion 600 is not formed in a portion, on the −D direction side of the liquid container 60*c*, to which the liquid outlet member 66 of the bag 60 is inserted.

The sealed portion 600 includes one end portion-side sealed portion 601 formed along the W direction at an end on the −D direction side. In the present embodiment, the first width W1, which is the width at at least the surrounding region PA of the connection member 61, of this one end portion-side sealed portion 601, is larger than the second width W2, which is the width of the sealed portion 600 at other end portions of the bag 60. The other end portions of the bag 60 are end portions excluding the one end portion 60*a* of the bag 60, and include the other end portion 60*b*, the end portion on the +W direction side, and the end portion on the −W direction side.

The surrounding region PA is a region, of the one end portion-side sealed portion 601, including portions adjacent to the connection member 61 in the W direction. The surrounding region PA may be in contact with the connection member 61 in the W direction, or may not be in contact therewith. The surrounding region PA may be in contact with the connection member 61 in the D direction, or may not be in contact therewith. The surrounding region PA may be overlapped with the connection member 61 in the T direction, or may not be overlapped therewith. The surrounding region PA is close enough to the connection member 61 such that another component or element cannot be interposed between the connection member 61 and the surrounding region PA. If the distance from the end of the connection member 61 in the −T direction to the one end portion-side sealed portion 601 is referred to as a "sealed portion height TA", the surrounding region PA preferably includes, of the one end portion-side sealed portion 601 in the W direction, a portion extending from the end of the connection member 61 in the −W direction at a length corresponding to the sealed portion height TA in the −W direction, and a portion extending from the end of the connection member 61 in the +W direction at a length corresponding to the sealed portion height TA in the +W direction. Also, if the width of the connection member 61 along the W direction is referred to as a "connection member width WA", the surrounding region PA preferably includes, of the one end portion-side sealed portion 601 in the W direction, a region extending from the end of the connection member 61 in the −W direction at a length corresponding to half of the connection member width WA in the −W direction, and a region extending from the end of the connection member 61 in the +W direction at a length corresponding to half of the connection member width WA in the +W direction, as shown in FIG. 16. Note that, in the present embodiment, the width of the one end portion-side sealed portion 601, over the entire region including the surrounding region PA, is larger than the second width W2, which is the width of the other end portions of the bag 60. Note that, if the width of the one end portion-side sealed portion 601 changes in the surrounding region PA, the first width W1 is an average width of the one end portion-side sealed portion 601 in the surrounding region PA. Also, if the second width W2 of the sealed portion 600 of the bag 60 on the +W direction side, the second width W2 of the sealed portion 600 on the −W direction side, and the second width W2 of the sealed portion 600 on the +D direction side are different, the first width W1 is larger than the maximum value of these second widths W2.

The end on the +D direction side of a portion, of the one end portion-side sealed portion 601, having the first width W1 is located on the +D direction side relative to the end of the connection member 61 on the +D direction side. That is, in the D direction, the connection member 61 is provided on the −D direction side relative to the end of the one end portion-side sealed portion 601 on the +D direction side.

In the present embodiment, the one end portion-side sealed portion 601 includes two first corner portions C1 at the respective ends in the W direction. The third width W3, which is a width of the one end portion-side sealed portion 601 along the D direction, in the two first corner portions C1 is larger than the first width W1. In the present embodiment, the third width W3 increases toward the ends in the W direction. Note that, in other embodiments, the third width W3 in one first corner portion C1, of the two first corner portions C1, may be larger than the first width W1.

In the present embodiment, when the internal region of the liquid container 60*c* is equally divided in the D direction into three regions, the end of the internal rigid member 87, which is constituted by the coupling member 85 and the spacer member 90, on the +D direction side is located in a central region CA of the three regions. Also, in the present embodiment, when the internal region of the liquid container 60*c* is equally divided in the W direction into three regions, the internal rigid member 87 is located in a central region of the three regions. Note that, when the internal region of the liquid container 60*c* is equally divided in the D direction into five regions, the end of the internal rigid member 87 on the +D direction side may be located in a central region of the five regions. Also, the end of the internal rigid member 87 on the +D direction side may be located at a center of the internal region of the liquid container 60*c*.

Figure 17:
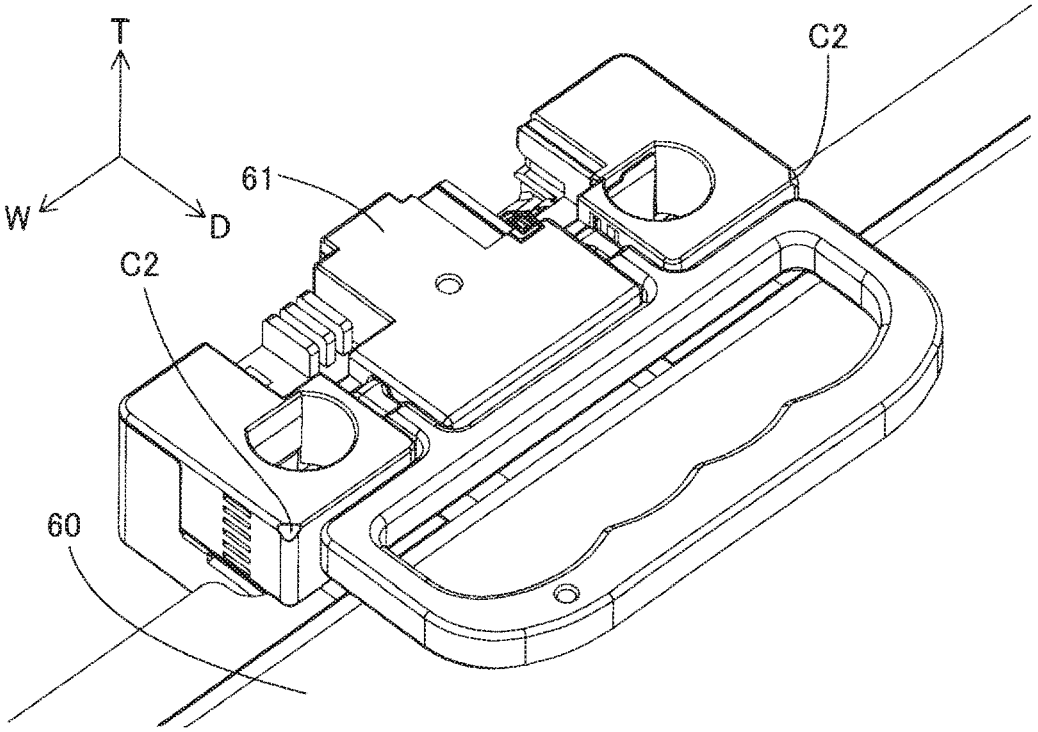
FIG. 17 is a perspective view illustrating an external shape of the connection member on a +T direction side when viewed from a +D direction side.
Figure 18:
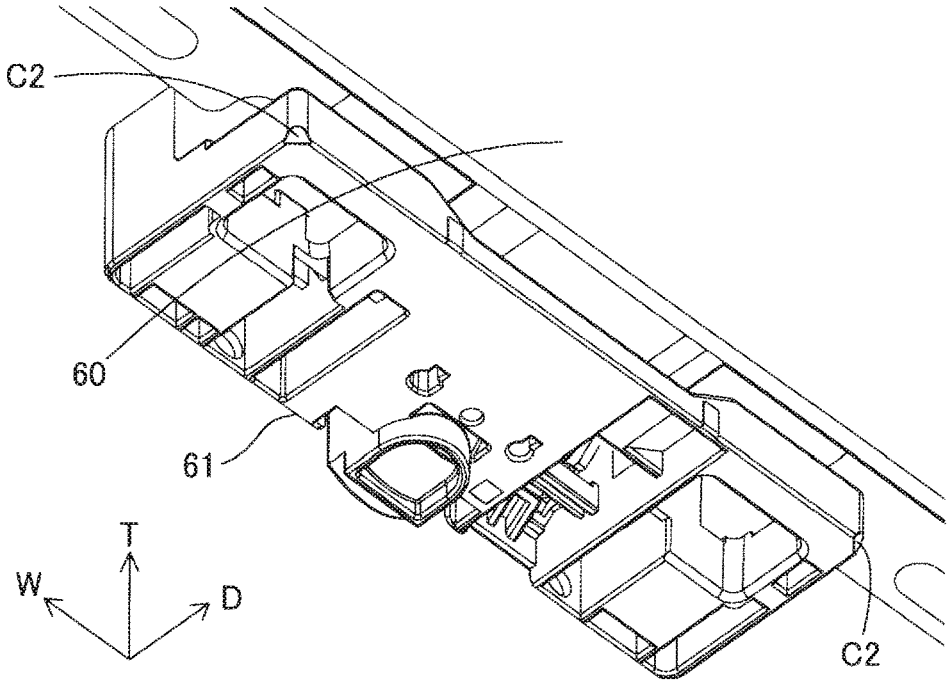
FIG. 18 is a perspective view illustrating the external shape of the connection member on a −T direction side when viewed from a +D direction side.

FIG. 17 is a perspective view illustrating an external shape of the connection member 61 on the +T direction side when viewed from a +D direction side. FIG. 18 is a perspective view illustrating the external shape of the connection member 61 on the −T direction side when viewed from the +D direction side. As shown in these diagrams, the connection member 61 of the present embodiment includes four second corner portions C2 at respective ends in the W direction on the +D direction side. The four second corner portions C2 each have a chamfered shape. The chamfer may be a round chamfer, or a chamfer inclined at 45 degrees. Note that the connection member 61 may have, without being limited to the four second corner portions C2, chamfered sides at the ends on the +D direction side.

According to the liquid container 20 of the present embodiment described above, the first width W1 of the sealed portion 600 of the bag 60 in the surrounding region PA of the connection member 61 is larger than the second width W2 of the other portions, and as a result, the connection member 61 can be kept from being influenced by a change in the thickness of the bag 60, which is caused by the thickness of the bag 60 being partially changed due to surface waviness and ripples of liquid inside the liquid container 60*c*. Therefore, the positional shift of the connection member 61 relative to the liquid ejection device 11 can be suppressed, and liquid can be stably supplied to the liquid ejection device 11. In particular, in the present embodiment, since the width of the bag 60 is large, the connection member 61 is easily influenced by surface waviness and ripples of liquid. However, in the present embodiment, since the first width W1 of the sealed portion 600 of the bag 60 in the surrounding region PA of the connection member 61 is larger than the second width W2 of the other portions, the connection member 61 can be effectively kept from being influenced by such a phenomenon.

Also, in the present embodiment, the one end portion-side sealed portion 601 includes the first corner portions C1 at the ends in the W direction, and the third width W3 of the sealed portion 600 in the first corner portions C1 is larger than the first width W1 in the surrounding region PA. Therefore, the stress due to the pressure of the liquid inside the liquid container 60*c* can be kept from being concentrated at the first corner portions C1 of the one end portion-side sealed portion 601. Therefore, the liquid can be suppressed from leaking out from the first corner portions C1 of the one end portion-side sealed portion 601.

Also, the liquid container 20 of the present embodiment includes the internal rigid member 87 that is connected to the liquid outlet member 66 and extends in the +D direction from the liquid outlet member 66 inside the liquid container 60*c*. Therefore, the connection member 61 can be kept from being influenced by surface waviness and ripples of the liquid, and the stress can be suppressed from accumulating in the internal rigid member 87. Therefore, damage to the internal rigid member 87 can be suppressed.

Also, in the present embodiment, when the internal region of the liquid container 60*c* is equally divided into three regions CA along the D direction, the end of the internal rigid member 87 in the +D direction is located in the central region CA of the three regions. Therefore, liquid can be easily supplied from the center of the liquid container 60*c* to the liquid outlet member 66. Therefore, liquid can be uniformly led out from the internal region of the liquid container 60*c*.

Also, in the present embodiment, the second corner portions C2 of the connection member 61 on the +D direction side have a chamfered shape. Therefore, if the liquid container 20 is dropped with the connection member 61 facing downward, and the liquid container 20 lands such that the bag 60 covers the connection member 61, or the like, the surface of the bag 60 can be kept from being damaged by coming into contact with the second corner portions C2 of the connection member 61 on the +D direction side.

Also, in the present embodiment, the leading end portion 323 of the liquid introduction needle 32 included in the liquid ejection device 11 is configured by combining the truncated cone 324 and the cone 325, and has a cone shape, as a whole, whose conical surface has a level difference. Therefore, when the liquid introduction needle 32 breaks a film FL provided in the liquid outlet member 66 of an un-used liquid container 20, a gap is generated between the liquid introduction needle 32 and the film FL, and with this, the ease of piercing the film FL with the leading end portion 323 can be improved. Therefore, the load to break the film FL can be reduced, and the liquid introduction needle 32 can be easily inserted into the liquid outlet member 66. Also, according to the present embodiment, since the liquid introduction needle 32 can be easily inserted into the liquid outlet member 66, the liquid introduction needle 32 can be kept in a stable state inside the liquid outlet member 66. Therefore, even if surface waviness and ripples occur in the liquid inside the bag 60, the liquid can be stably supplied from the liquid container 20 to the liquid ejection device 11.

Also, according to the liquid container 20 of the present embodiment, because the liquid outlet tubes 80 are provided inside the liquid container 60*c* provided in the bag 60, channels for liquid are secured in the vicinity of the liquid outlet tubes 80, and the channels inside the bag 60 are unlikely to be blocked. Also, the end portions of the liquid outlet tubes 80 on the +D direction side act as substantial supply ports, that is, supply ports for directly supplying liquid to the liquid ejection device 11, and the spacer member 90 is present on the depth direction side relative to the end portions of the liquid outlet tubes 80 on the +D direction side, and as a result, the end portions of the liquid outlet tubes 80 on the +D direction side and the channels on the deeper side are unlikely to be blocked. Moreover, since the inclined faces 91 are provided in the spacer member 90 on the deeper side in the direction along which the liquid flows when suctioned, the bag 60 is likely to collapse conforming to the shape of the inclined faces 91 from the deeper side to the near side, and the channels on the deeper side of the spacer member 90 are unlikely to be blocked. Therefore, according to the present embodiment, the likelihood that liquid cannot be sufficiently supplied to the liquid ejection device 11 when the bag 60 contracts can be reduced. Also, in the present embodiment, the first channels 95 and the second channels 96 are formed in the spacer member 90, and therefore the channels inside the liquid container 60*c* can be effectively kept from being blocked when the bag 60 contracts.

Also, in the present embodiment, the liquid outlet tubes 80 include the first channel portion 81 and the second channel portion 82, the first channel portion 81 suctions liquid with a low concentration, and the second channel portion 82 suctions liquid with a high concentration, and the liquid is supplied to the liquid ejection device 11 after mixing the liquid with a low concentration and the liquid with a high concentration in the liquid outlet portion 52, and as a result, the concentration of liquid to be supplied to the liquid ejection device 11 can be further stabilized.

Also, in the present embodiment, at least one of the lowermost portion of the spacer member 90 and the uppermost portion of the spacer member 90 is in contact with the internal face of the bag 60, in the attachment orientation, and therefore, the bag 60 tends to contract from the contact portion with the spacer member 90 in conformity with the shape of the inclined faces 91 of the spacer member 90, and the channels inside the liquid container 60*c* can be effectively suppressed from being blocked.

Also, in the present embodiment, the first leading end 81*b* of the first channel portion 81 and the second leading end 82*b* of the second channel portion 82 are fixed to the spacer member 90. Therefore, the positions of the first leading end 81*b* and the second leading end 82*b*, which are substantial supply ports, do not change. Also, when an impact is applied to the liquid container 20 as a result of the liquid container 20 being dropped when carried or the like, the liquid outlet tubes 80 are unlikely to be separated from the spacer member 90. Therefore, the concentration of liquid to be supplied to the liquid ejection device 11 can be further stabilized.

Also, in the present embodiment, the first base end 81*a* of the first channel portion 81 and the second base end 82*a* of the second channel portion 82 are aligned in the horizontal direction, in the attachment orientation, and the first leading end 81*b* and the second leading end 82*b* are aligned in the vertical direction. Therefore, the first leading end 81*b* and the second leading end 82*b* are unlikely to move in the W direction, and liquid can be suctioned from them at stable positions. Also, liquid suctioned from the first channel portion 81 is mixed with liquid suctioned from the second channel portion 82 after the flow is changed from the state of flowing side by side in the vertical direction to the state of flowing side by side in the horizontal direction, and as a result, the concentration of liquid to be supplied to the liquid ejection device 11 can be further stabilized.

Also, in the present embodiment, since the spacer member 90 is fixed to the liquid outlet member 66, the positional relationship between the spacer member 90 and the liquid outlet member 66 can be stabilized. Therefore, the likelihood of the concentration of liquid to be supplied to the liquid ejection device 11 changing depending on individual liquid containers 20 can be reduced.

Also, in the present embodiment, since the second channels 96 for causing liquid to flow in a direction that intersects the D direction are provided in the spacer member 90, liquid can be easily suctioned from directions other than the D direction. Therefore, when the concentration of liquid changes along a direction other than the D direction, the concentration of liquid to be supplied to the liquid ejection device 11 can be further stabilized.

Also, in the present embodiment, the spacer member 90 is provided with the partition 97, and the partition 97 is provided at a position between the first leading end 81*b* of the first channel portion 81 and the second leading end 82*b* of the second channel portion 82, in the T direction, and as a result, the liquid with a low concentration that is present on an upper side in the container 60*c* and the liquid with a high concentration that is present on a lower side are unlikely to be mixed in the vicinity of the first leading end 81*b* and the second leading end 82*b*. Therefore, it is possible to suppress a situation in which liquid with low concentration is suctioned from both the first leading end 81*b* and the second leading end 82*b*, and liquid with high concentration is unlikely to be suctioned. As a result, the concentration of liquid to be supplied to the liquid ejection device 11 can be further stabilized.

B. Second Embodiment

Figure 19:
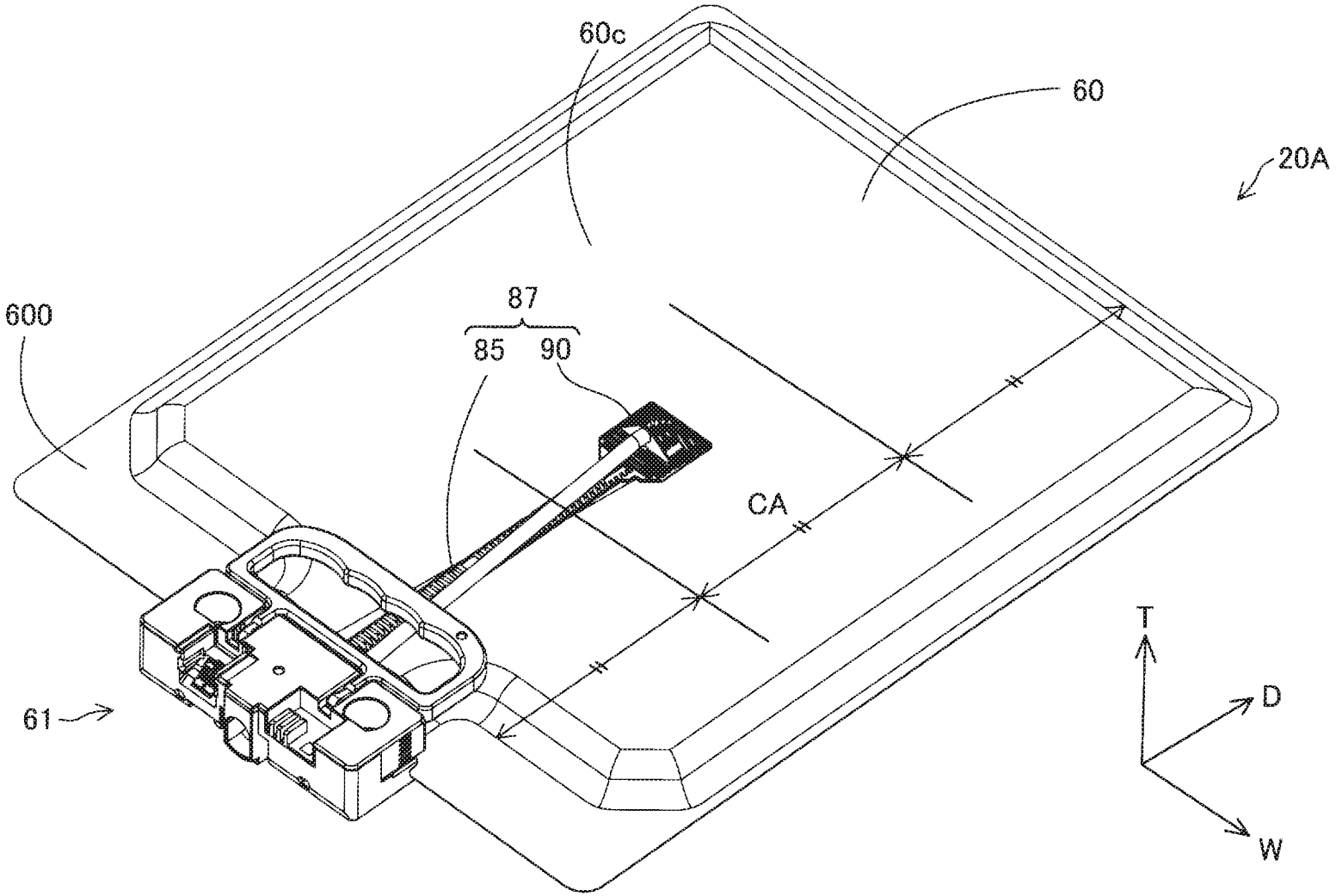
FIG. 19 is a diagram illustrating a configuration of a liquid container in a second embodiment.

FIG. 19 is a diagram illustrating a configuration of a liquid container 20A in a second embodiment. In FIG. 19 as well, similarly to FIG. 16, an internal rigid member 87 is illustrated so as to be superimposed on a bag 60, for convenience of description. The liquid container 20A of the second embodiment has a larger size along the D direction of the bag 60 than the liquid container 20 of the first embodiment. Specifically, the size of the bag 60 in the D direction in the present embodiment is larger than the size along the W direction and the size along the T direction. Also, in the present embodiment, the size of the bag 60 along the W direction is larger than the size along the T direction. The configurations of the bag 60 of the liquid container 20A are the same as those of the first embodiment except for the sizes. In the present embodiment, the length of the coupling member 85 is increased in the +D direction in correspondence to the fact that the size of the bag 60 along the D direction is increased relative to the first embodiment. Also, in the present embodiment as well, the end portion, on the +D direction side, of an internal rigid member 87 that is constituted by a coupling member 85 and a spacer member 90 is located, when the internal region of a liquid container 60*c* is equally divided into three regions along the D direction, in a central region CA of the three regions, similarly to the first embodiment. Therefore, in the present embodiment as well, liquid can be easily supplied from the center of the liquid container 60*c* to a liquid outlet member 66 that is covered by a connection member 61, similarly to the first embodiment. Therefore, liquid can be uniformly led out from the internal region of the liquid container 60*c*.

C. Third Embodiment

Figure 20:
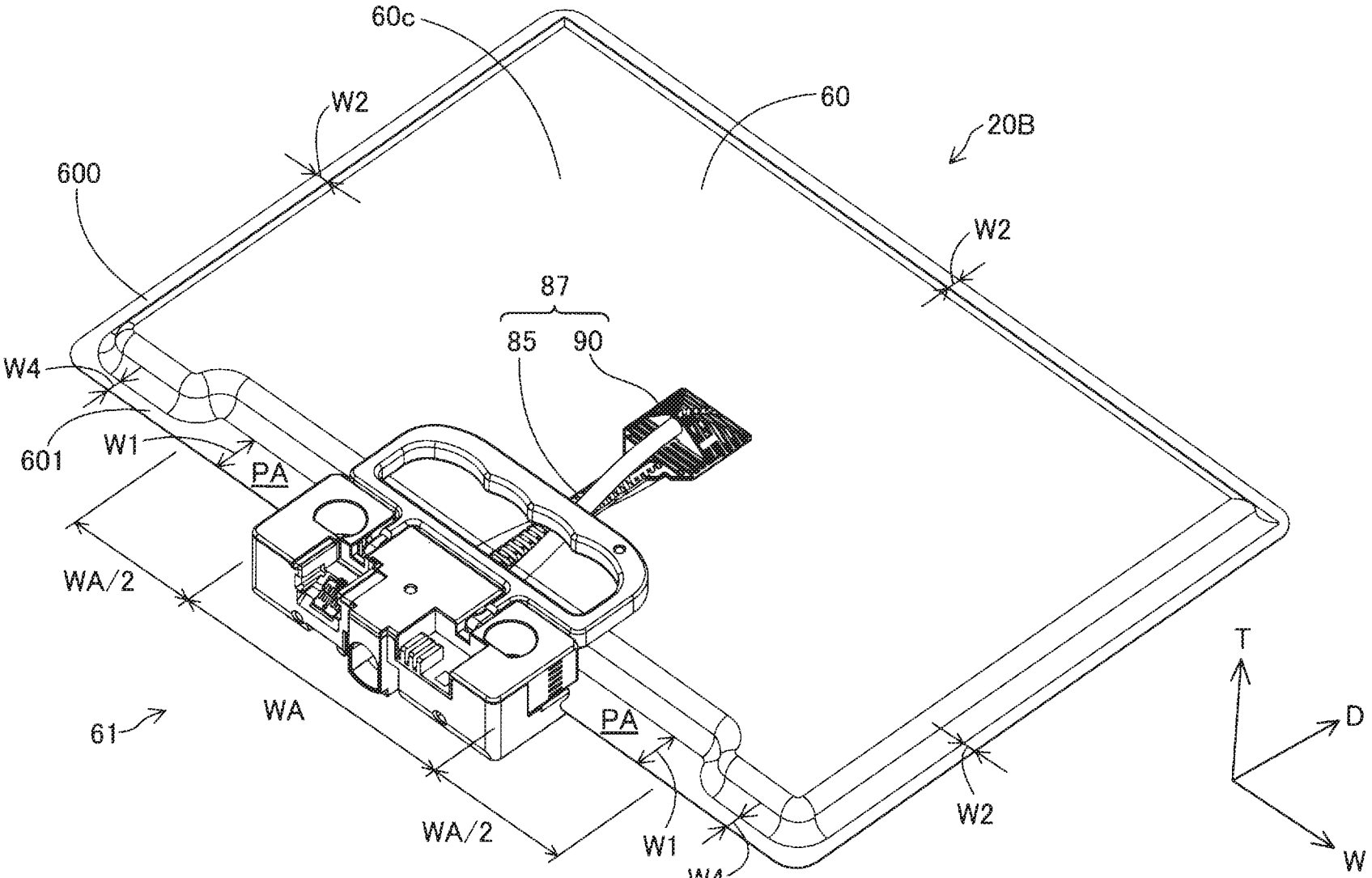
FIG. 20 is a diagram illustrating a configuration of a liquid container in a third embodiment.

FIG. 20 is a diagram illustrating a configuration of a liquid container 20B in a third embodiment. In FIG. 20 as well, similarly to FIG. 16, an internal rigid member 87 is illustrated so as to be superimposed on a bag 60, for convenience of description. In the first embodiment described above, the width of the sealed portion 600 in a one end portion-side sealed portion 601 is larger than a second width W2, which is the width of other end portions of the bag 60, over the entire region of the one end portion-side sealed portion 601. In contrast, in the third embodiment, a width W4 of a region of the one end portion-side sealed portion 601 excluding a surrounding region PA is smaller than the first width W1. In this case as well, because the width of the one end portion-side sealed portion 601 in the surrounding region PA is larger than the second width W2, which is the width of the other end portions of the bag 60, a connection member 61 is kept from being influenced by surface waviness and ripples of liquid. Note that the width W4 of the region of the one end portion-side sealed portion 601 excluding the surrounding region PA is preferably the same as the second width W2, which is the width of the other end portions, or larger than the second width W2.

D. Other Embodiments

D-1: In the first embodiment, the third width W3, which is the width at the first corner portions C1 of the one end portion-side sealed portion 601 is larger than the first width W1 in the surrounding region PA. In contrast, the third width W3 at a corner portion of the one end portion-side sealed portion 601 may be the same as the first width W1 in the surrounding region PA, or smaller than the first width W1.

D-2: In the embodiments described above, an internal rigid member 87 is provided that extends from the liquid outlet member 66 in the +D direction inside the liquid container 60*c*. In contrast, the liquid container 20 may not include the internal rigid member 87. Also, in the embodiments described above, the internal rigid member 87 is constituted by the coupling member 85 and the spacer member 90, but the internal rigid member 87 may be constituted by only the coupling member 85.

D-3: In the embodiments described above, all of the four second corner portions C2 of the connection member 61 on the +D direction side have a chamfered shape, but some of the second corner portions C2 may be chamfered, or none of the second corner portions C2 may be chamfered.

D-4: The present disclosure can be applied to, not limited to an inkjet printer and a liquid container for supplying ink to the inkjet printer, any liquid ejection devices that eject liquid other than ink, and a liquid container that is used in such liquid ejection devices. For example, the present disclosure can be applied to the following various liquid ejection devices and liquid containers.

(1) Image recording apparatuses such as a facsimile apparatus (2) Color material ejection recording apparatuses used to manufacture color filters for image display apparatuses such as a liquid crystal display (3) Electrode material ejection apparatuses used to form electrodes for organic EL (Electro Luminescence) displays, field emission displays (FED), or the like (4) Liquid consuming apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid consuming apparatuses that perform pinpoint ejection of lubricating oil to precision machines such as a watch and a camera (9) Liquid consuming apparatuses that eject a transparent resin solution such as a UV-cured resin solution onto substrates in order to form micro-hemispherical lenses (optical lenses) or the like used in optical communication elements or the like

(10) Liquid consuming apparatuses that eject acid or alkaline etchant in order to etch substrates or the like

(11) Liquid consuming apparatuses that include liquid consumption heads for discharging a very small amount of any other kind of droplet.

Note that the "droplet" refers to a state of the liquid discharged from liquid ejection devices, and includes droplets having a granular shape, a tear-drop shape, and a shape with a thread-like trailing end. The "liquid" mentioned here need only be a material that can be consumed by liquid ejection devices. For example, the "liquid" need only be a material in a state where a substance is in a liquid phase, and a liquid material having a high or low viscosity, sol, gel water, and other liquid materials such as inorganic solvent, organic solvent, solution, liquid resin, liquid metal, and metallic melt are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink.

E. Other Aspects

The present disclosure is not limited to the embodiments described above, and can be achieved with various configurations without departing from the gist of the invention. For example, the technical features in the embodiments that correspond to the technical features in the aspects described in the following can be replaced or combined as appropriate in order to solve some or all of the problems described above, or in order to achieve some or all of the above-described effects. A technical feature that is not described as essential in the specification can be deleted as appropriate.

(1) According to one aspect of the present disclosure, a liquid container for supplying liquid to a liquid ejection device is provided. The liquid container includes: when three directions that orthogonally intersect each other are denoted as a D direction, a T direction, and a W direction, a positive direction of the D direction is denoted as a +D direction, and the direction opposite to the +D direction is denoted as a −D direction, a direction in which the size of an external shape of the liquid container is smallest is the T direction, and a direction orthogonal to the D direction and the T direction is the W direction, the D direction and the W direction extending in a horizontal direction in a state in which the liquid container is attached to the liquid ejection device, a flexible bag provided with a liquid container that internally contains the liquid; a liquid outlet member attached to a one end portion of the bag on the −D direction side; and a connection member that is attached to the one end portion so as to cover the liquid outlet member and a portion of the one end portion from the outside. The bag includes a sealed portion on an outer periphery side relative to the liquid container, the sealed portion includes a one end portion-side sealed portion that is formed along the W direction at an end on the −D direction side, a first width, which is a width of the one end portion-side sealed portion in at least a surrounding region of the connection member, is larger than a second width, which is a width of the sealed portion at other ends of the bag, and an end, on the +D direction side, of a portion, of the one end portion-side sealed portion, having the first width is located on the +D direction side relative to an end of the connection member on the +D direction side.

According to the liquid container of such an aspect, since the width of the sealed portion of the bag in the surrounding region of the connection member that is attached to the one end portion of the bag is larger than the width of the sealed portion at other ends of the bag, the connection member is kept from being influenced by surface waviness and ripples of liquid inside the liquid container. Therefore, the positional shift of the connection member relative to the liquid ejection device can be suppressed, and ink can be stably supplied to the liquid ejection device.

(2) In the liquid container of the above-described aspect, the one end portion-side sealed portion may include a first corner portion at an end in the W direction, and a third width, which is a width of the one end portion-side sealed portion in the first corner portion, may be larger than the first width.

With the liquid container of such an aspect, because the stress can be kept from being concentrated in the vicinity of the first corner portion of the one end portion-side sealed portion, ink can be kept from leaking out from the bag.

(3) The liquid container of the above-described aspect may further include an internal rigid member that is coupled to the liquid outlet member, and extends in the +D direction from the liquid outlet member, inside the liquid container.

With the liquid container of such an aspect, the connection member can be suppressed from being influenced by surface waviness and ripples of the liquid, and the stress can be suppressed from accumulating in the internal rigid member. Therefore, the damage of the internal rigid member can be suppressed.

(4) In the liquid container of the above-described aspect, when an internal region of the liquid container is equally divided into three regions in the D direction, an end of the internal rigid member in the +D direction may be located in a central region of the three regions.

With the liquid container of such an aspect, liquid is easily supplied from the center of the liquid container to the liquid outlet member.

(5) In the liquid container of the above-described aspect, the connection member may include a second corner portion at an end in the +D direction and at an end in the W direction, and the second corner portion may have a chamfered shape.

With the liquid container of such an aspect, the surface of the bag can be suppressed from being damaged by the second corner portion of the connection member when the liquid container is dropped or the like.

(6) According to another aspect of the present disclosure, a liquid ejection device is provided to which a liquid container including a liquid outlet member is detachably attached. The liquid ejection device includes a hollow liquid introduction needle to be inserted into the liquid outlet member. A leading end portion of the liquid introduction needle is constituted by a combination of a truncated cone that has a first bottom face and an upper face whose diameter is smaller than that of the first bottom face, and a cone that is provided on the upper face of the truncated cone, and has a second bottom face whose diameter is smaller than that of the upper face of the truncated cone, and the central axis of the cone matches the central axis of the truncated cone.

According to the liquid ejection device of such an aspect, since the leading end portion of the liquid introduction needle is constituted by a combination of a truncated cone and a cone, the liquid introduction needle can be easily inserted into the liquid outlet member of the liquid container. Therefore, the liquid introduction needle can be kept in a stable state inside the liquid outlet member, and liquid can be stably supplied from the liquid container to the liquid ejection device.

The present disclosure can be realized in various aspects other than the aspects as the liquid container and the liquid ejection device described above. For example, the present disclosure can be realized in aspects such as a system including the liquid container and the liquid ejection device and a manufacturing method of the liquid container.

What is claimed is:

1. A liquid container for supplying liquid to a liquid ejection device, comprising:

when three directions that orthogonally intersect each other are denoted as a D direction, a T direction, and a W direction, a positive direction of the D direction is denoted as a +D direction, and the direction opposite to the +D direction is denoted as a −D direction, a direction in which the size of an external shape of the liquid container is smallest is the T direction, and a direction orthogonal to the D direction and the T direction is the W direction, the D direction and the W direction extending in a horizontal direction in a state in which the liquid container is attached to the liquid ejection device, a flexible bag provided with a liquid container that internally contains the liquid;

a liquid outlet member attached to a one end portion of the bag on the −D direction side; and a connection member that is attached to the one end portion so as to cover the liquid outlet member and a portion of the one end portion from the outside, wherein the bag includes a sealed portion on an outer periphery side relative to the liquid container, the sealed portion includes a one end portion-side sealed portion that is formed along the W direction at an end on the −D direction side of the flexible bag, the one end portion-side sealed portion comprises a surrounding region that is adjacent to the connection member in the W direction, a first width, which is a width of the one end portion-side sealed portion in at least the surrounding region, is larger than a second width, which is a width of the sealed portion at other ends of the bag, and a +D direction end of a portion of the one end portion-side sealed portion is located on the +D direction side relative to a +D direction end of the connection member.

2. The liquid container according to claim 1, wherein the one end portion-side sealed portion includes a first corner portion at an end in the W direction, and a third width, which is a width of the one end portion-side sealed portion in the first corner portion, is larger than the first width.

3. The liquid container according to claim 1, further comprising an internal rigid member that is coupled to the liquid outlet member, and extends in the +D direction from the liquid outlet member, inside the liquid container.

4. The liquid container according to claim 3, wherein, when an internal region of the liquid container is equally divided into three regions in the D direction, an end of the internal rigid member in the +D direction is located in a central region of the three regions.

5. The liquid container according to claim 1, wherein the connection member includes a second corner portion at an end in the +D direction and at an end in the W direction, and the second corner portion has a chamfered shape.

* * * * *